US007854075B2

(12) United States Patent
Kosmas

(10) Patent No.: US 7,854,075 B2
(45) Date of Patent: Dec. 21, 2010

(54) ORTHOTIC DEVICE FOR OPEN SHOES

(76) Inventor: Cheryl Kosmas, 43 Bayview Ave., Belvedere, CA (US) 92920

( * ) Notice: Subject to any disclaimer, the term of this patent is extended or adjusted under 35 U.S.C. 154(b) by 827 days.

(21) Appl. No.: 11/777,466

(22) Filed: Jul. 13, 2007

(65) Prior Publication Data

US 2008/0010861 A1 Jan. 17, 2008

Related U.S. Application Data

(63) Continuation-in-part of application No. 29/282,085, filed on Jul. 11, 2007, now Pat. No. Des. 594,198.

(60) Provisional application No. 60/830,795, filed on Jul. 13, 2006.

(51) Int. Cl.
*A43B 13/18* (2006.01)

(52) U.S. Cl. ..... 36/44; 36/43

(58) Field of Classification Search ..... 36/43, 36/44, 91, 180, 88, 71
See application file for complete search history.

(56) References Cited

U.S. PATENT DOCUMENTS

| | | | | |
|---|---|---|---|---|
| 1,730,466 | A | 10/1929 | Mallott | |
| 2,404,731 | A * | 7/1946 | Johnson | 12/146 M |
| 2,865,097 | A * | 12/1958 | Vollrath, Jr. et al. | 36/43 |
| 4,597,196 | A | 7/1986 | Brown | |
| 4,694,590 | A * | 9/1987 | Greenawalt | 36/91 |
| 4,718,179 | A * | 1/1988 | Brown | 36/44 |
| 4,808,469 | A * | 2/1989 | Hiles | 428/318.6 |
| 4,864,740 | A * | 9/1989 | Oakley | 36/44 |
| 5,184,409 | A * | 2/1993 | Brown | 36/44 |
| 5,373,650 | A | 12/1994 | Dananberg et al. | |
| D371,894 | S | 7/1996 | Gay et al. | |
| D393,726 | S | 4/1998 | Sweeney | |
| D396,138 | S | 7/1998 | Roy | |
| D396,948 | S | 8/1998 | Moore et al. | |
| D399,042 | S | 10/1998 | Strawser et al. | |
| 6,233,847 | B1 * | 5/2001 | Brown | 36/44 |
| 6,408,543 | B1 * | 6/2002 | Erickson et al. | 36/100 |
| D462,510 | S | 9/2002 | Goodrich et al. | |
| 6,453,578 | B1 | 9/2002 | Yung et al. | |
| 6,474,003 | B2 * | 11/2002 | Erickson et al. | 36/100 |
| D475,184 | S | 6/2003 | Polifroni | |
| 6,598,321 | B2 | 7/2003 | Crane et al. | |
| 6,618,960 | B2 * | 9/2003 | Brown | 36/44 |
| D487,185 | S | 3/2004 | Grisoni et al. | |
| D490,970 | S | 6/2004 | Bray et al. | |

(Continued)

FOREIGN PATENT DOCUMENTS

JP 2002248002 A 9/2002

(Continued)

*Primary Examiner*—Marie Patterson
(74) *Attorney, Agent, or Firm*—Aka Chan LLP

(57) ABSTRACT

An orthotic device is designed to be reused and reapplied in open shoes include an adhesive layer which securely, but temporarily, bonds the insole to a shoe. In some embodiments, the insole both supports and cushions a foot. In other embodiments, the insole solely cushions the foot. The supporting insoles include an arch support and a heel lift. The cushioning insoles include a flat sole pad, a contoured sole pad, a ball of foot pad and a heel spur pad. In some embodiments, a textile covering is included over the insole.

19 Claims, 25 Drawing Sheets

U.S. PATENT DOCUMENTS

| | | | | |
|---|---|---|---|---|
| D497,470 | S | 10/2004 | Crewdson | |
| D498,043 | S | 11/2004 | Walker | |
| D498,577 | S | 11/2004 | Crewdson | |
| D517,291 | S | 3/2006 | Vasyli | |
| D532,586 | S | 11/2006 | Birkenstock | |
| D543,680 | S | 6/2007 | Dean et al. | |
| D552,838 | S | 10/2007 | Quinn | |
| 2002/0007569 | A1* | 1/2002 | Crane et al. | 36/44 |
| 2002/0083618 | A1* | 7/2002 | Erickson et al. | 36/44 |
| 2004/0194344 | A1* | 10/2004 | Tadin | 36/44 |
| 2004/0211086 | A1* | 10/2004 | Dananberg | 36/11.5 |
| 2005/0278978 | A1 | 12/2005 | Swigart | |
| 2006/0026865 | A1* | 2/2006 | Grisoni et al. | 36/43 |
| 2008/0271340 | A1* | 11/2008 | Grisoni et al. | 36/43 |

FOREIGN PATENT DOCUMENTS

| | | | |
|---|---|---|---|
| JP | 2003164303 | A | 6/2003 |

* cited by examiner

ORTHOTIC DEVICE FOR OPEN SHOES

CROSS-REFERENCE TO RELATED APPLICATIONS

This patent application claims the benefit of U.S. provisional patent application 60/830,795, filed Jul. 13, 2006, and is a continuation-in-part of U.S. design patent application Ser. No. 29/282,085, filed Jul. 11, 2007 now Pat. No. D594198, which are incorporated by reference.

BACKGROUND OF THE INVENTION

The present invention relates generally to orthotic devices such as supportive and cushioning insoles for footwear. More particularly, the present invention relates to durable, reusable insoles, pads, arch supports, and heel lifts for open shoes.

There are a great many mass-produced orthotic and insole products. Some insoles primarily provide cushioning, while others primarily provide support. Cushioning insoles are generally formed of soft material, such as foam or gel materials, while support insoles are generally formed of rigid or semi-rigid polymers. People suffering from any of a wide variety of foot-related ailments that can be relieved through additional cushioning or support, or who simply desire more cushioning or support, or both, than is available from their shoes, can purchase these insoles and insert them into their shoes. Typically, these insoles are temporarily retained by the walls of the shoes. Cushioning insoles are designed to conform to the interiors of shoes, while products designed for support maintain their own structure. Heel lifts are a support product used for individuals with a leg length discrepancy to assist with achieving improved alignment of the pelvis and spine.

Open shoes, such as men's and women's sandals, women's "strappy" dress heels and slides, do not have walls to maintain the position of cushioning insoles or supportive devices, or both. FIG. 1 shows a women's dress shoe 100, which is a typical open shoe. The dress shoe includes a shoe body 140 including a heel 145. The shoe body 140 also includes the foot bed 130 upon which a wearer stands while wearing the dress shoe. The dress shoe 100, as shown in FIG. 1, includes a forefoot strap 110 and the ankle strap 120, which is adjustable to retain the shoe on a wearer's foot.

Alternately, there may only be a forefoot strap on the dress shoe 100. The dress shoe 100 is typical in that only about 30 percent of the outer perimeter of the foot bed 130 is shielded from view by the straps 110 and 120. Further, this openness permits visibility of nearly the entire perimeter of the foot bed 130. A wide variety of open shoes exist, each permitting visibility of its foot bed to varying degrees; however, in each case, use of a typical cushioning or supporting insole permits visibility of the device through the open shoe.

There have been some attempts to provide cushioning insoles for open shoes. These insoles are thin, flat, and made of a gel which only cushions the foot. These products are not intended to nor do they provide a structural orthotic arch support to the foot for an open shoe.

Current orthotic products designed to support a wearer's foot would be unfashionably visible through open shoes.

Further, existing orthotics (e.g., supportive insoles) include no means for securing themselves to remain in place while used in an open shoe, and therefore would fall out of place when not weighted down by a wearer's foot.

Therefore, there is a need for orthotic products for open shoes that provide arch and other orthotic support for the foot.

BRIEF SUMMARY OF THE INVENTION

An orthotic device or supportive insole provides support and cushioning of a foot. Another implementation of an insole provides solely cushioning for a foot. The supporting insole includes a support layer and a layer that is both cushioning and supportive. Each layer of the supporting insole is designed to cushion or support, or both, corresponding regions of the foot. The supporting insole includes at least one arch region for supporting an arch region of a foot and a forefoot region for cushioning the forefoot of the foot. The supporting insole includes a heel cup region for supporting a heel region of a wearer's foot. The support regions assist in maintaining correct anatomical alignment of the foot, which can assist in preventing or improving, or both, some pathologies of the foot, especially ones associated with pes planus. Some cushioning insoles provide cushioning for the foot and are not supportive. While some cushioning insoles embodiments contain strategically raised areas which allows for extra comfort and a minimal amount of cushioning support.

The insoles can be used in either an open shoe, e.g., a sandal, or a closed shoe, e.g., a loafer. However, the advantages of the insole are well-suited for use in an open shoe. To use the insole, a person places it on the foot bed of the shoe where the sole of the foot normally rests. Thus, when the person is wearing the shoe, the insole rests on top of the foot bed of the shoe and the foot of the person rests on top of the insole.

A supportive insole in accordance with the present invention is adapted for use with shoes of a certain heel height or range of heel heights. For example, one embodiment of the insole is adapted for use with flats, another embodiment is adapted for use with heels. This preference arises because the position of a wearer's foot varies along with heel height. For example, the relative angle between the arch and heel of the foot, or break angle, generally increases as heel height increases. FIG. 1 illustrates these angles. By providing supportive insoles adapted to selected ranges of heel heights, the supporting insoles of the present invention take advantage of the biomechanical changes that occur in the foot when wearing flats or heels. The embodiments of the present invention adapted for use with high heels are configured to provide a reduced heel angle as well as arch support.

The bottom of the insole includes a layer of a reusable tacky or adhesive material. When a person places the insole on the foot bed of a shoe, and applies sufficient force initially to adhere the insole to the foot bed, no additional force is required to hold it in place. The insole adheres to the foot bed without moving until the person removes the insole from the foot bed by applying sufficient force to an edge of the insole. Once the insole is removed from a first shoe in this manner, the insole can be placed in a second shoe, and adhere to the foot bed of the second shoe in the same manner. The reusable adhesive material permits repeated removal and application of the insole to a succession of different shoes (or reapplication to the same shoe) substantially without loss of its adhesive property.

In one embodiment, the supporting insole includes three layers, including a top layer, a middle layer, and a bottom layer. The top layer is made of a polymer type material to provide cushioning and support throughout the footprint of the foot by varying the thickness of the material. The middle layer includes a semiflexible polymer which provides support and shock absorption to varying areas of the foot. Exemplary materials include semirigid plastics, such as polycarbonate, which can be provided in varying thicknesses for support or shock-absorption, or both. The middle layer provides structure for the product. The bottom layer includes a reusable adhesive material, a viscoelastic polymer with adhesive-like properties capable of repeated removal and reapplication substantially without loss of its adhesive property.

Unlike typical reusable adhesives that wear out over time, a viscoelastic polymer with inherent adhesive-like properties may be used and reused many times. Since the adhesiveness or tackiness of the material is an inherent property of the material, the orthotic device of the invention may be used many times. The viscoelastic polymer may become soiled with dirt (so it no longer sticks as well as when it was new), but the material may be washed (e.g., with soap and water), and then the material will adhere like it did when it was new.

The three layers are bonded together by one or more permanent adhesives. By the use of a permanent adhesive, the layers are not designed to be separated by the user, but layers may be forcibly separated such as by cutting or sawing, or a chemical or other means. In addition, the three layers are clear or translucent, as are the one or more permanent adhesives once they have bonded the three layers together. Thus, the assembled supporting insole is translucent or semitranslucent. Further, a thickness of the assembled insole is less than about 5 millimeters.

In an embodiment, the three layers are not coextensive. In some embodiments, the middle layer includes an arch support structure and heel cup and is included only in a support region of the insole, while the top layer extends over the entire top surface of the insole. Thus, portions of the insole include one layer, while a support region of the insole includes three layers. In some embodiments a covering layer, such as a fabric, is disposed on top of the insole.

In another aspect, a supportive insole includes a cushioning layer of varying thickness to assist in shock absorption, load distribution, and comfort during gait.

The insole cushion includes two layers. A top layer is a soft polymer material to provide cushioning. A bottom layer includes a reusable adhesive material, a viscoelastic polymer with adhesive properties capable of repeated removal and reapplication without loss of its adhesive property. In some embodiments, this insole cushion also includes a fabric layer on its upper surface.

The insole cushion is constructed by bonding the two layers together with one or more permanent adhesives. Further, the two layers are translucent, as are the one or more permanent adhesives once they have bonded the two layers together. Thus, in an embodiment, the insole cushion is translucent. Another embodiment is one layer only made of a viscoelastic polymer with adhesive properties and a thin coating on top to eliminate the adhesive component where the foot comes in contact with the insole. In some embodiments the insole cushion includes a fabric layer.

In yet another aspect, a heel lift includes either two, three, or more layers. The top layer is a soft polymer material to provide cushioning or it may have a thin layer of a semiridged polymer to provide support on top of a cushioning material. The middle layer is composed of a soft polymer type material. This middle layer may have different thicknesses or heights in order to provide the appropriate amount of lift for each specific user. The bottom layer includes of a reusable material, a viscoelastic type material with adhesive like properties capable of removal and reapplication without loss of its adhesive property. In another embodiment, the middle layer has two or three layers. The bottom aspect of each layer includes a thin layer of viscoelastic polymer material permanently bonding to the upper layer. These layers are able to bond together due to the adhesive property of the viscoelastic material, yet have the capability of removal and reapplication without loss of the adhesive property. In some embodiments, this heel lift also includes a fabric layer on its upper surface.

In an implementation, the invention is an an orthotic supportive device including: a first layer including a first thickness and cushion regions having a greater thickness than the first thickness; a second layer, connected or attached to the first layer, including a semiflexible polymer having greater rigidity than the first layer; and a third layer, connected to the second layer, including a viscoelastic polymer. The first, second, and third layers may be translucent.

A first cushion region of the first layer, may be positioned at a first position where a base of a heel of a foot will be received by the orthotic device. The first cushion region cushions a calcaneus of the foot. A first cushion region of the first layer may be positioned at a first position which will receive a medial arch zone of a foot. A first cushion region of the first layer may be positioned at a first position which will receive a lateral arch zone of a foot. A second cushion region of the first layer may be positioned around the first position and is U-shaped. A second cushion region of the first layer may be positioned at a second position which will receive a metatarsal zone of the foot. A second cushion region of the first layer may be positioned at a third position, forward and lateral of the second position. The second layer may be at about the first position is a concavity.

The viscoelastic polymer of the third layer may be positioned at about the first second position. The second layer may include first and second thickened regions, on a first and second side of the first position, extending away from the first layer. The viscoelastic polymer may not beneath the first and second thickened regions. There may be multiple pieces of viscoelastic polymer in the third layer. The viscoelastic polymer may have an inherent adhesive or tacky property.

The first layer may include at least six cushion regions. A first cushion region may have a different thickness from a second cushion region. A first cushion region may have the same thickness as a second cushion region.

In an implementation, the invention is an orthotic supportive device including: a first layer including a first thickness and cushion regions having a greater thickness than the first thickness; a second layer, connected or attached to the first layer, including a semiflexible polymer having greater rigidity than the first layer; and a third layer, connected or attached to the second layer, including a viscoelastic polymer, where the viscoelastic polymer has an inherent adhesive property, and the first, second, and third layers are translucent.

A first of the cushion regions may be above the viscoelastic polymer of the third layer. A second of the cushion regions may be positioned to receive a metatarsal zone of a foot during use of the orthotic device.

Other objects, features, and advantages of the present invention will become apparent upon consideration of the following detailed description and the accompanying drawings, in which like reference designations represent like features throughout the figures.

DETAILED DESCRIPTION OF THE INVENTION

Though many of the embodiments shown of the present invention are all right-side orthotic insoles, one of skill in the art will understood that the invention also covers left-side insoles, which are generally mirror images identical to the right insoles pictured.

The present invention includes three classes of embodiments, a three-layer supportive orthotic insole with cushioning features, cushioning insole devices, and a heel lift.

Three-Layer Supportive Orthotic Device or Arch Support Device

Below, the embodiments that include a heel pad structure with a resilient portion are discussed with reference to FIGS. 2A, 2B, 3A, 3B, 4, and 6. These embodiments are typical of the three-layer class of supportive insoles consistent with the present invention, which prescribe certain structural features in a discreet, removable, and reusable supportive orthotic insole for use in open shoes.

Figure 2A:
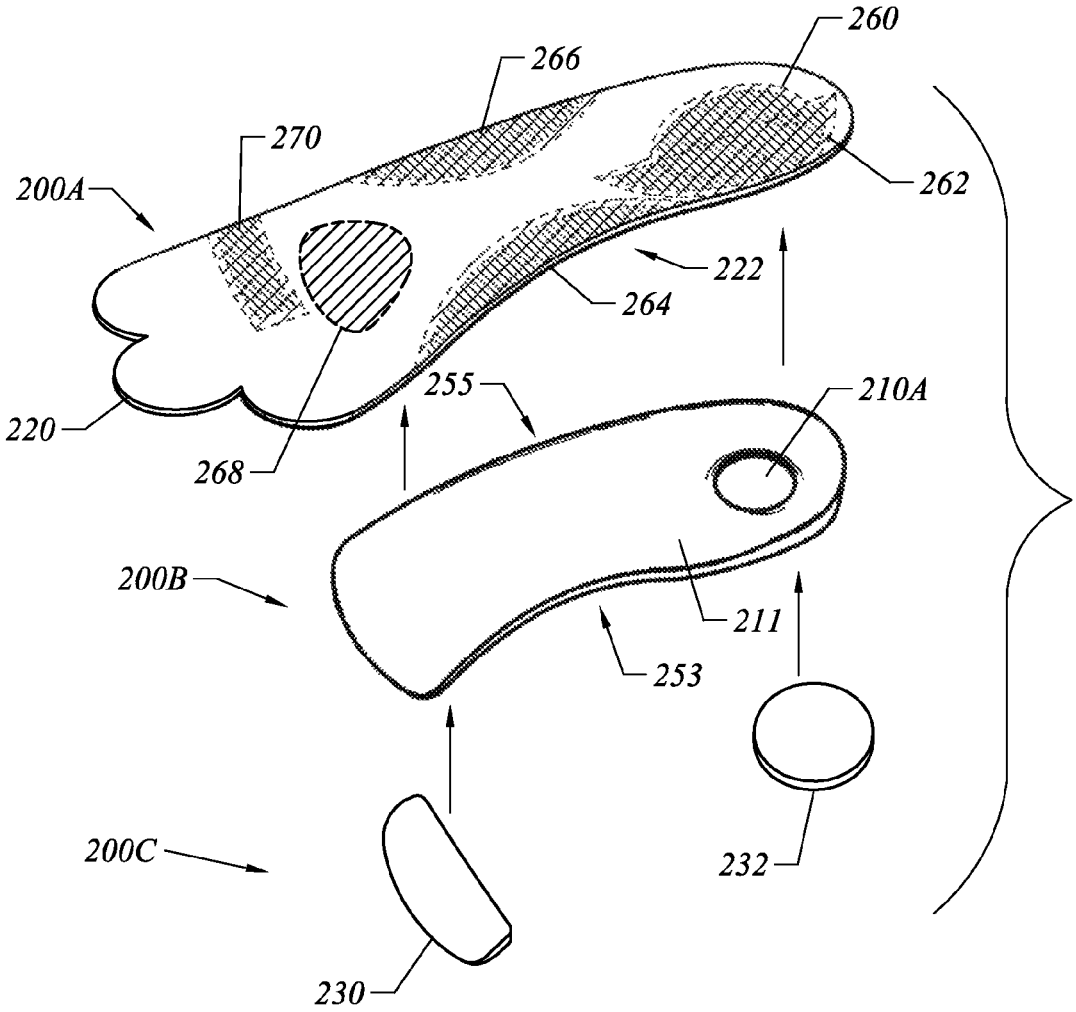
FIG. 2A shows a perspective exploded view of an embodiment of a right insole including a resilient heel support in accordance with the present invention.
Figure 2B:
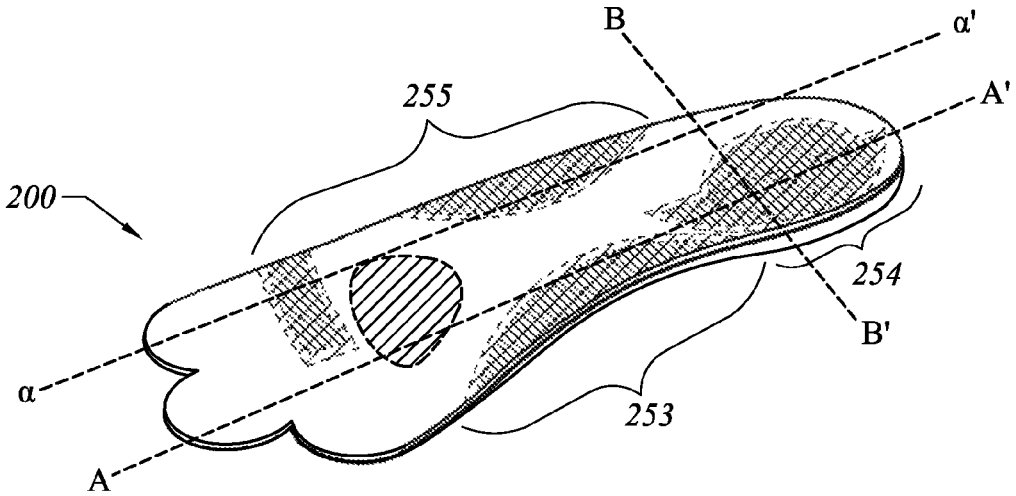
FIG. 2B shows a perspective view of an embodiment of a right insole including a resilient heel support in accordance with the present invention.

An insole 200, e.g., FIG. 2B, includes the parts or layers shown in FIG. 2A, including an upper portion 200A, a contoured piece 200B, and a lower portion 200C. In a specific implementation, the upper portion 200A is formed of a layer 220 of soft polymer material to provide cushioning. Layer 220 is shaped like the foot bed of a shoe, extending along substantially the entire length of a wearer's plantar region excluding the toes. Layer 200A may be referred as the first layer or top layer.

Contoured piece 200B is formed of a semirigid polymer plastic, e.g., polycarbonate, and located to align with an arch region 253 and the heel region 254 of insole 200 when assembled. Layer 200B may be referred to as the second layer or middle layer.

Lower portion 200C is formed of one or more regions (e.g., 230 and 232) of a viscoelastic adhesive capable of repeated removal and reapplication substantially without loss of its adhesive property. In an implementation, upper layer 220 extends from the heel region to the ball of the foot, stopping before the toes. Contoured piece 200B extends from the heel region to the end of the arch region distal from the heel. Layer 200C may be referred to as the third layer or bottom layer.

In an implementation, lower layer 200C may include a single piece that extends from the heel region to the end of the arch region distal from the heel. In another implementation, lower layer 200C includes two regions, one region 230 is located at approximately the ball of the foot and another region 232 is located at the heel. In another implementation, lower layer 200C includes a single region such as region 232, located at the heel.

In an implementation, the bottom layer includes viscoelastic polymer with adhesive properties, which allows the device to adhere to the bed of the shoe and stay in place when in use and then removed after each use if desired without affecting the bed of the shoe. The viscoelastic polymer adhesive property may be referred to as sticky or tacky. So the bottom layer allows the orthotic device to stick to the shoe when in use.

The orthotic device will continue to stick to the shoe during use, even when the person is walking or running. For example, when a person walks in a flip-flop or sandal, a shoe snaps back up to hit the bottom of the foot with each step. When the orthotic device is used, the device will remain sticking to the shoe, not the foot, with each step.

The property of the material allows repeated use without loosing the adhesive property. In addition to the viscoelastic material providing an adhesive property, the viscoelastic material also provides shock absorption feature to reduce the shock on heel strike.

As shown in FIG. 2A, the upper layer 220 is approximately foot- or sole-shaped. In an embodiment, the upper layer 220 may include raised regions or bumps (not shown) configured to provide increased grip. In an embodiment, the bumps may be arranged in a decorative flower-like pattern (not shown). Further, the front edge of the upper layer 220 may be configured as part of the decorative pattern. In an alternate embodiment, the front edge is rounded off and is not configured as part of a pattern. In some alternate embodiments, there is also an absence of raised regions or bumps.

As shown in FIGS. 2A and 2B, upper layer 220 includes areas of varying thickness to provide both support and comfort to the wearer. The areas of thickness vary from about 0.5 millimeters to about 3.5 millimeters of thickness. There is a heel area 260 of increased thickness to fill a depression or hole 210A within middle layer 200B (FIG. 2A). A depression (as shown) may be a concave region (like a spoon) which can hold a greater thickness of the top layer of material (i.e., layer 220). There may be an opening or hole (not shown), where there is an absence of material. In alternate implementations, the middle layer may not have a hole or depression.

There is an area 262 of increased thickness on the medial aspect of the heel which extends to the medial arch, used to control pronation. A medial arch support area 264 and a lateral arch support area 266 of increased thickness provide cushion and support. A pad area 268 of increased thickness at the distal aspect of the metatarsal shafts, in the shape of a metatarsal pad, decreases the load on the metatarsal heads. An area 270 of increased thickness under the metatarsal heads three through five increases loading in this area and ultimately shifts the load from the first and second metatarsal heads.

The areas 260, 262, 264, 266, 268 and 270 of increased thickness are thicker than the remainder of the upper layer. In different embodiments, this thickness ranges from about 0.5 millimeters to about 3.5 millimeters. Also, in some embodiments, the outer edges of the areas 260, 262, 264, 266, 268 and 270 are slightly less thick than the center of the areas, such that the areas 260, 262, 264, 266, 268 and 270 gradually ramp up or rise to the maximum thickness. In some implementation, these areas may resemble mounds, relative to a flat surface.

Contoured piece 200B provides a contoured surface 211 upon which upper layer 220 rests in an assembled insole 200 (e.g., FIG. 2B). The contoured surface includes a medial arch region 253, a lateral arch region 255, and a heel cup region surrounding a hole or depression 210A. The depression 210A includes a thin layer of material, permitting some flexibility. These structures provide support to a wearer's foot in medial arch region 253, a lateral arch region 255, and heel region 254 of the insole. In comparison to the middle layer, lower layer 200C is also essentially without rigid structure or contour.

Assembled insole 200 relies on contoured piece 200B to provide structure in heel region 254, medial arch region 253, and the lateral arch area 255 to support a wearer's foot and the upper layer to provide cushioning with the addition of support in the areas of increased thickness. In an embodiment, lower layer 200C includes a viscoelastic, reusable adhesive or tacky material which also provides shock absorption and cushioning. Insole 200 is assembled by sandwiching contoured piece 200B between upper portion 200A and lower portion 200C.

In construction of insole 200, adhesive is applied to a lower or bottom surface 222 of upper layer 220, contoured upper surface 211 and lower surface of contoured piece 200B, and upper surface 232 of the lower layer 200C to provide a bond such as a permanent bond between the three layers. Alternatively, an adhesive is applied to only a subset of the surfaces mentioned above. The area 260 of increased thickness fills in the depression or concavity 210A or hole or opening (not shown). A concavity may be spoon-shaped, wherein the concavity holds the extra thickness of cushioning material.

Figure 6:
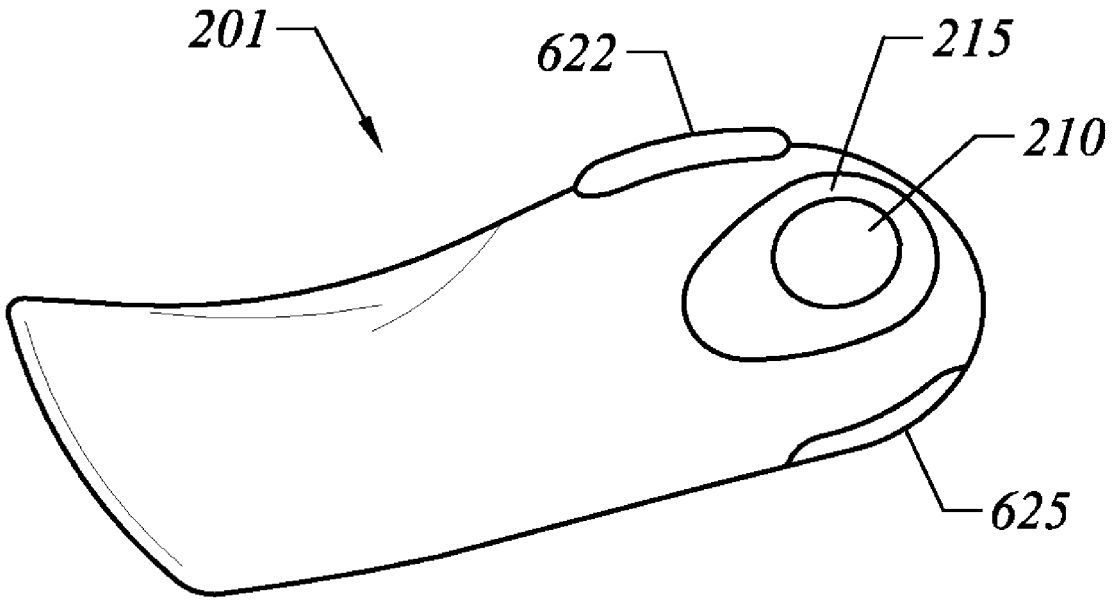
FIG. 6 shows a bottom perspective view of an embodiment of a rigid structure in accordance with the present invention.

Referring now to FIG. 6, a bottom perspective view of an arch support structure 201 (or second or middle) in accordance with an embodiment of the present invention is shown. The arch support structure shown in FIG. 6 may be used in the middle layer in an embodiment of the invention. The arch structure 201 includes the heel contact region 215. Also, the thin layer under the depression 210 is shown from below.

In an embodiment of an orthotic supportive device, the arch support structure has what may be referred to as "training wheels" 622 and 625 on the left and right side of the rear area of the device. In the figure, the training wheels are at the edges of the orthotic supportive device, but in other implementations, the training wheels may be somewhere between the edge on the base (or center) of the heel position. These training wheels are rigid portions that extend further below (toward the shoe) the bottom arch support. When pressure is applied from the top of the arch support (such as when a person stands on arch support), the training may contact the top surface of the shoe, which adds medial and lateral stability. The training wheels are optional and an implementation of the device of the invention may not include the training wheels.

More specifically, in an implementation, the middle layer is a semiflexible (or rigid) injection-molded polymer designed in general to the contour the plantar surface of the foot to support and improve the anatomical alignment of the foot. The heel portion of the orthotic device has a concave base in which the calcaneus rests. As discussed previously, there may be a depression or opening at a position where the base of the heel rests.

The concave heel base assists in reducing the peak plantar pressure beneath the calcaneus. The curvature of the heel cup also adds stability to the rear foot. There is a slight depression on the upper surface of the heel bed; this is filed with the top layer of a soft polymer the combination of cushioning with the concave heel cup assist in decreasing peak plantar pressure.

Optionally, on the bottom surface of the heel area is a convex shape on the outer edge are one or more training wheels which is a thickened area extending down but not touching the gel bed when not weight bearing. When positioned under a weight-bearing load the training wheels become in contact with the heel bed providing medial and lateral stability to the rear foot.

The semiflexible material allows for the lowering of the training wheels. This allows for midrange physiological motion in the rear foot while at the same time provides support medially and laterally at the end ranges.

The training wheel on the medial aspect is positioned slightly anterior to the lateral training wheel, which assist in providing some additional stability to the calcaneus against pronatory forces. There is a curvature on the medial side to support the medial arch and a curvature on the lateral side to support the lateral arch. On the top surface of the medial arch, there is a small grove to allow for the plantar fascia.

Figure 1:
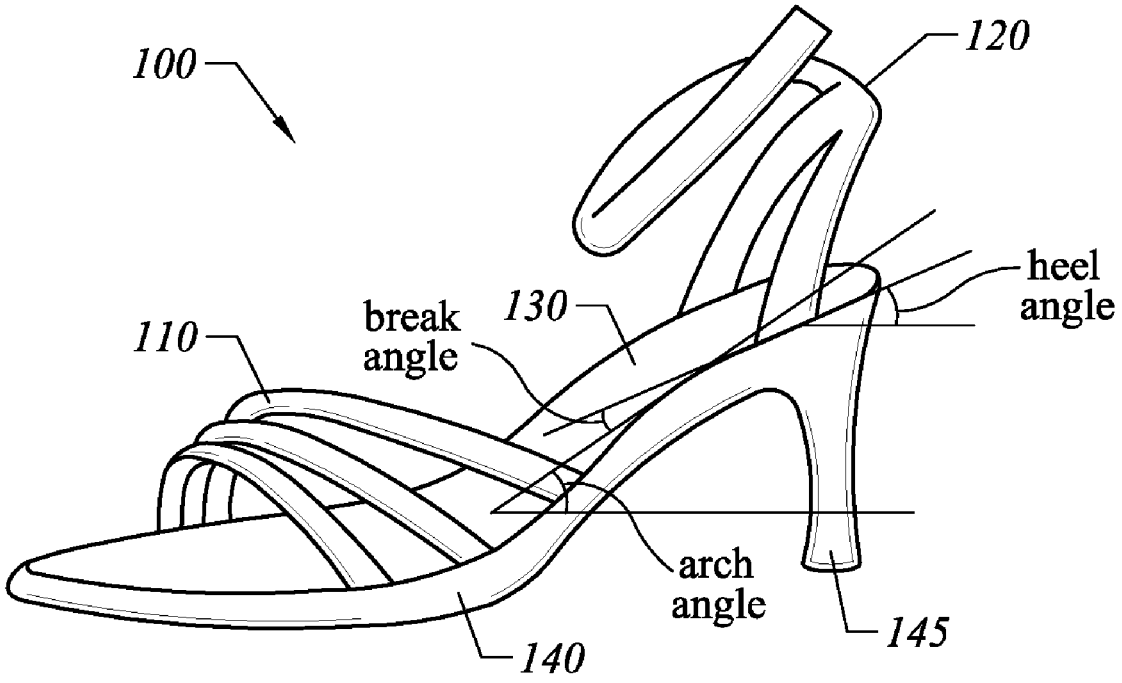
FIG. 1 shows a women's open high-heel dress shoe.
Figure 3A:
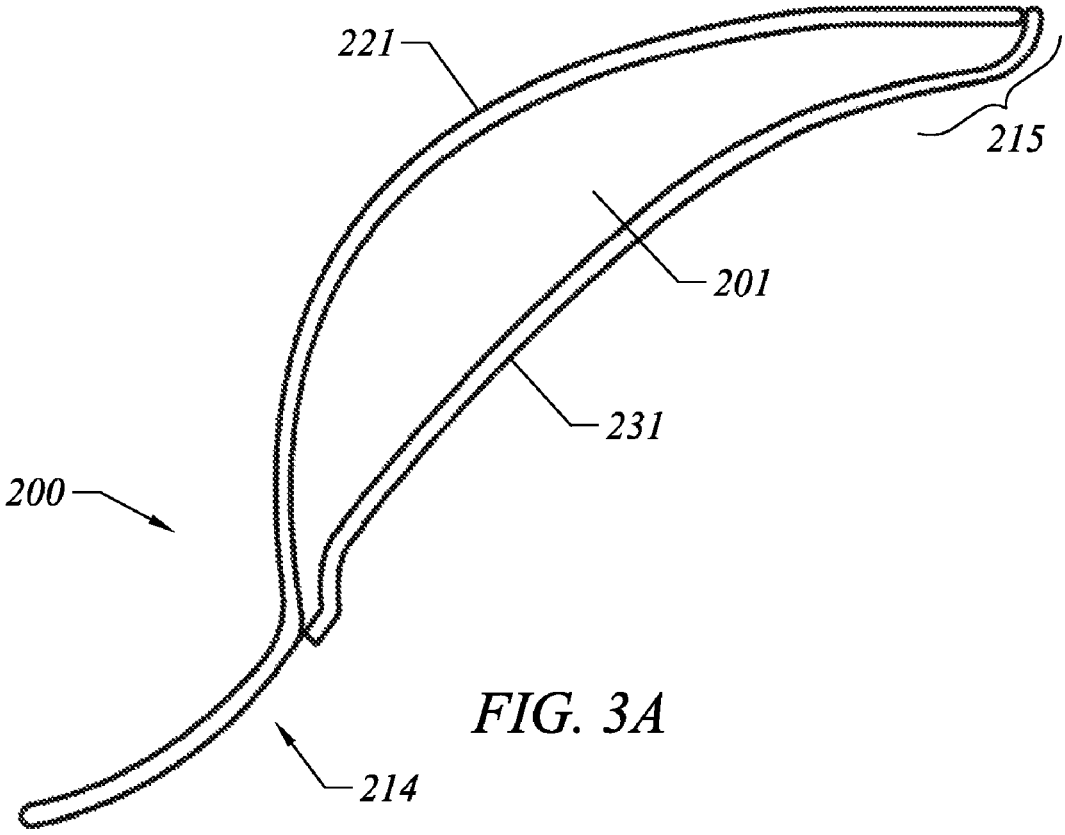
FIG. 3A shows a side dual cross-sectional view of an embodiment of an insole in accordance with the present invention.

Referring now to FIGS. 2B and 3A, an upper surface 211 of insole 200 is contoured to engage and cushion a wearer's foot, while an aspect of the lower surface 231 is configured to rest upon and engage the foot bed of a shoe. The top surface of the section shown in FIG. 3A illustrates an A-A' plane (from FIG. 2B), while the bottom surface of the section shown in FIG. 3A illustrates an $\alpha$-$\alpha'$ plane (from FIG. 2B). In some embodiments, the shape of rigid contoured portion 200B, is modified to fit the slope of the foot bed in a high-heeled shoe, as shown. Here, a heel contact region 215 and the overall shape of arch structure 201 are configured to decrease a heel angle experienced by a wearer when using the insole. Relative to the same shoe without the insole, this modification of the heel angle can also affect the break angle (see FIG. 1) experienced by the wearer.

As described earlier, the break angle increases with heel height. To maintain this correlation, some embodiments of the present invention are adapted for heels by increasing the break point angle.

Lower surface 231 includes a reusable adhesive material. In an embodiment, lower surface 231 contacts a foot bed of a shoe at one or multiple discrete contact regions. Prior to use, the insole 200 is applied to the foot bed of an open shoe (such as the shoe 100 of FIG. 1) whereupon the reusable adhesive material that composes the lower surface 231 impermanently bonds with the foot bed of the shoe at one or more contact regions. In an embodiment, heel contact region 215 and front edge 214 of arch structure 201 are the primary contact regions at which lower surface 231 adheres to the foot bed. The total area of the contact regions and adhesive strength of lower surface 231 are sufficient to ensure that the insole 200 adheres to the foot bed of the open shoe, and remains in place whether the shoe is worn or not. In an implementation, the insole remains attached to the shoe when the shoe wearer is walking, even when there is no heel strap (such as the case for sandals).

Figure 3B:
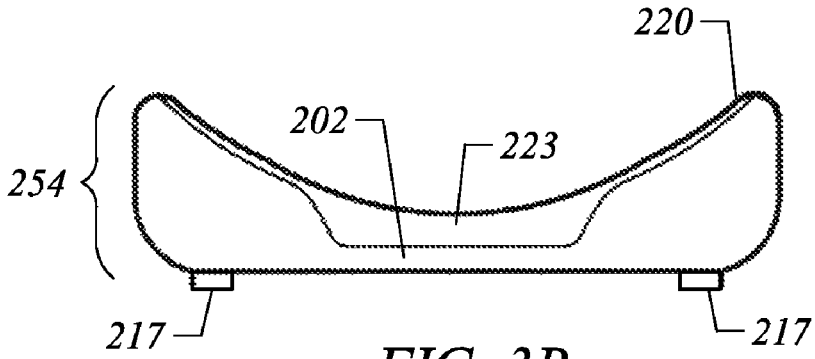
FIG. 3B shows a rear cross-sectional view of an embodiment of an insole in accordance with the present invention.

Referring now to FIG. 3B, the section of insole 200 along the B-B' plane is shown (from FIG. 2B). As shown, a thickened portion 223 of upper layer 220 protrudes into the depression of the arch structure 201. A thin layer of material 202 lies between thickened portion 223 and lower layer 232. This figure also shows two training wheels regions 217, which were previously discussed above. As shown by this cross section, regions 217 extend from bottom of the insole. Training wheels 217 are between the edge of the insole and the depression or concavity region 223. The training wheels are optional and embodiments of the invention may not include training wheels regions.

To remove insole 200 from a shoe, an edge is pulled from the foot bed of the shoe, and the insole is peeled from the foot bed. Upon removal, the reusable adhesive material maintains its adhesive or tacky properties such that it can be applied to a foot bed of a different shoe or reapplied to the original shoe. Alternatively, insole 200 can be used in a closed shoe, however certain advantages that the insole 200 provides, such as discreetness, are not needed in a closed shoe. In an implementation, the entire insole is clear or translucent so that it is less noticeable when used in an open shoe. In an alternative implementation, the sides of the insole are clear or translucent while the areas covered by the foot may not be.

Figure 4:
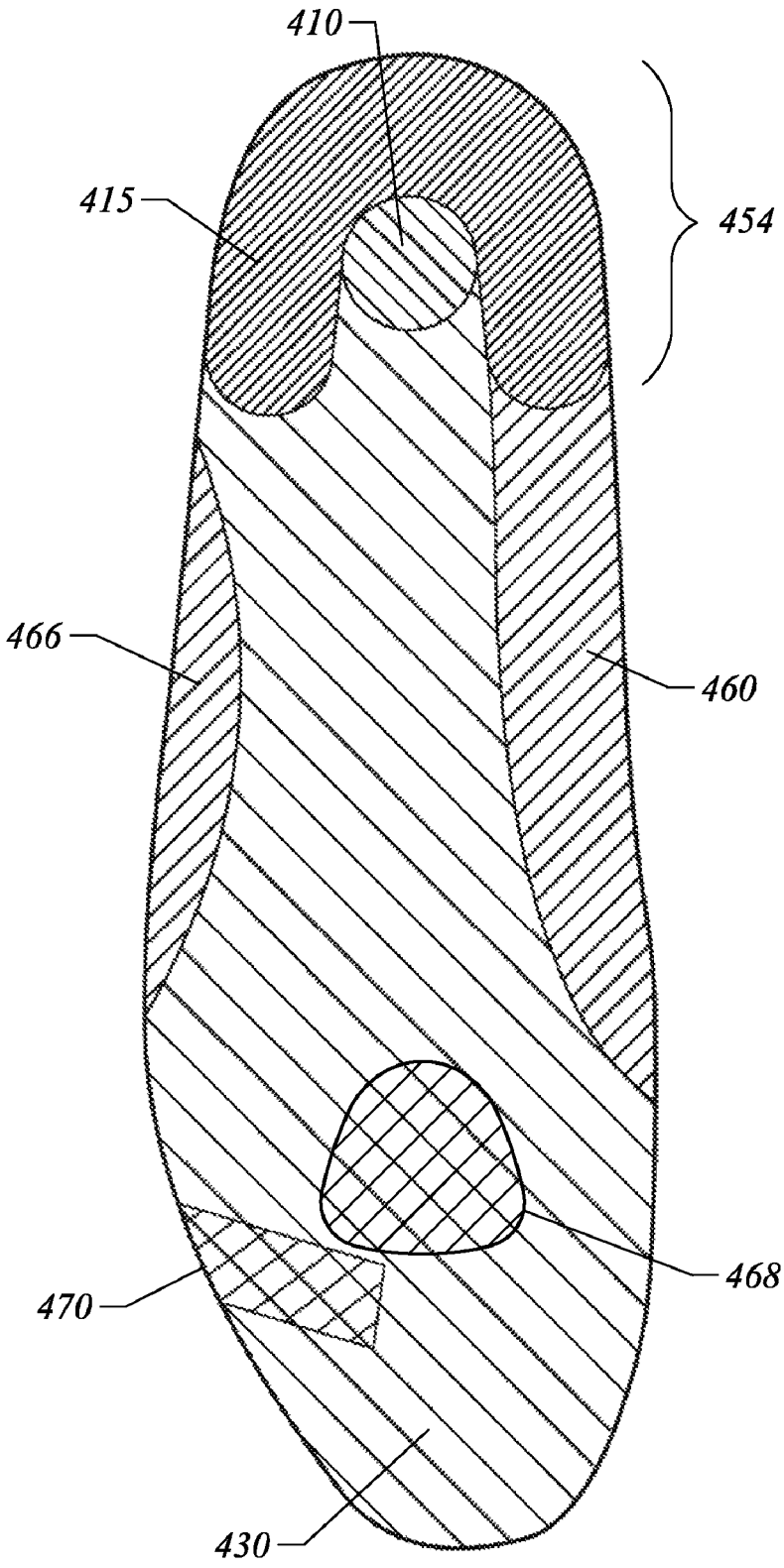
FIG. 4 shows a top view of an embodiment of a right insole in accordance with the present invention illustrating several regions of cushioning and support.

Insole 200 provides several support zones, as shown in FIG. 4. The two primary support zones are a medial arch zone 460, a lateral arch zone 466, and a heel region 454. A plantar zone 430 provides primarily cushioning. A heel zone 415 surrounds a heel pad 410 in a heel region 454. A heel zone 415 provides primarily support, while a heel pad 410 provides several forms of cushioning. A thickened area 468 functions as a metatarsal pad, shifting loads in the fore foot and taking pressure off the metatarsal heads. A thickened area 470 shifts loads under the metatarsal heads.

In a specific implementation of the invention, the first or top layer has a certain thickness and there are one or more regions having greater thickness. The top layer provides both support and cushioning. The top layer cushions the foot from the heel to the ball of the foot. The top layer may be a gel, silicon, or other soft polymer. Compared with the second or middle layer, the top layer has greater flexibility and cushioning, and less rigidity.

Within the top layer, there are six specific areas, which have varying degrees of increased thickness. Each area offers either cushioning, support or both, to specific areas of the foot. A specific implementation of the invention may have any of any one or number of increased thickness or cushion regions, and in any combination. For example, a specific implementation of the invention may have one, two, three, four, five, or six of the cushion regions described.

The areas within the top layer that vary in thickness function to assist in aligning the foot to shift weight-bearing loads. The thicknesses of each of the thickened regions may be exactly the same, or may be different and vary from each other. Further the thickness of the thickened regions may have varying thickness within the same region. As an example, a thickened region may increase in thickness gradually, such as a mound, where it is thickness, not at an edge, but at some other point within the region (e.g., a geometric center). Some specific regions of increased thickness include:

Area-1 (410 in FIG. 4): Increased thickness at the base of the heel, this cushions the calcaneus during loading and assist in disperses weight-bearing forces.

Area-2 (262 in FIG. 2): Increased thickness on the medial aspect of the heel bed. This raised area offers support to the calcaneus to assist in proper alignment. It also assists in controlling the rear foot motion which assists in reducing pronation. It also offers cushioning to the medial aspect of the calcaneus.

In an alternative implementation, area-2 may be a thickened U-shaped region surrounding area-1, such as region 415 in FIG. 4. Generally, area-2 follows the outline of the outside heel of a foot and provide cushioning.

Area-3 (460): Increased thickness on the medial arch of the foot. The increased thickness offers cushioning to the arch as well as additional support to assist in proper alignment of the foot.

Area-4 (466): Increased thickness on the lateral arch of the foot. The increased thickness offers cushioning to the arch as well as additional support to assist in proper alignment of the foot.

Area-5 (468): Increased thickness under the distal aspect of the second, third, and fourth metatarsal shaft. This assists in shifting weight bearing loads on the ball of the foot and assists in proper alignment as well as providing cushioning.

Area-6 (470): Increased thickness under the metatarsal heads numbers three, four, and five. This area causes increased weight bearing by bringing the ground to the foot as a result there is less weight bearing pressure under the first and second metatarsal heads. In a specific implementation, area-6 is rectangular in shape, such as shown in FIG. 4. The region is forward (more toward the toe) and lateral (toward the outside of the foot) of area-5. Area-5 may or may not touch area-6.

As discussed above, an orthotic supportive device of the invention may have any number of the six regions identified above, have additional regions not discussed above, and other variations.

Returning to FIG. 2A, thickened area 260 of the upper layer 220 protrudes into depression 210A, providing pliant cushioning, attenuating impact and providing resilient support. In addition to the above thickened areas, there are other supportive and cushioning aspects to layer 220 as described above. In heel region 454, there is a raised area 262 medially to assist in pronation control and improving alignment of the rear foot. Over medial arch zone 460, there is a thickened area 264 which provides additional support to the medial arch as well as a soft cushioning effect.

There is also a thickened area 266 in the lateral arch area which assists in supporting the lateral arch as well as a cushioning effect. In the fore foot of top layer 220, there is a thickened area 268 which functions as a metatarsal pad to assist in shifting loads in the fore foot focusing on taking pressure off the second and third metatarsal heads. There is also a thickened area 270 in a rectangular configuration, positioned under the second through fifth metatarsal shafts, which serves to shifts loads under the metatarsal heads as well as slow down the loading rate onto the ball of the foot during gait.

The additional cushioning and support provided by the insole 200 in the heel area helps relieve pathologies of the foot which result in heel pain and foot pain which may result from abnormal gait patterns due to over pronation.

Figures 2C, 2D:
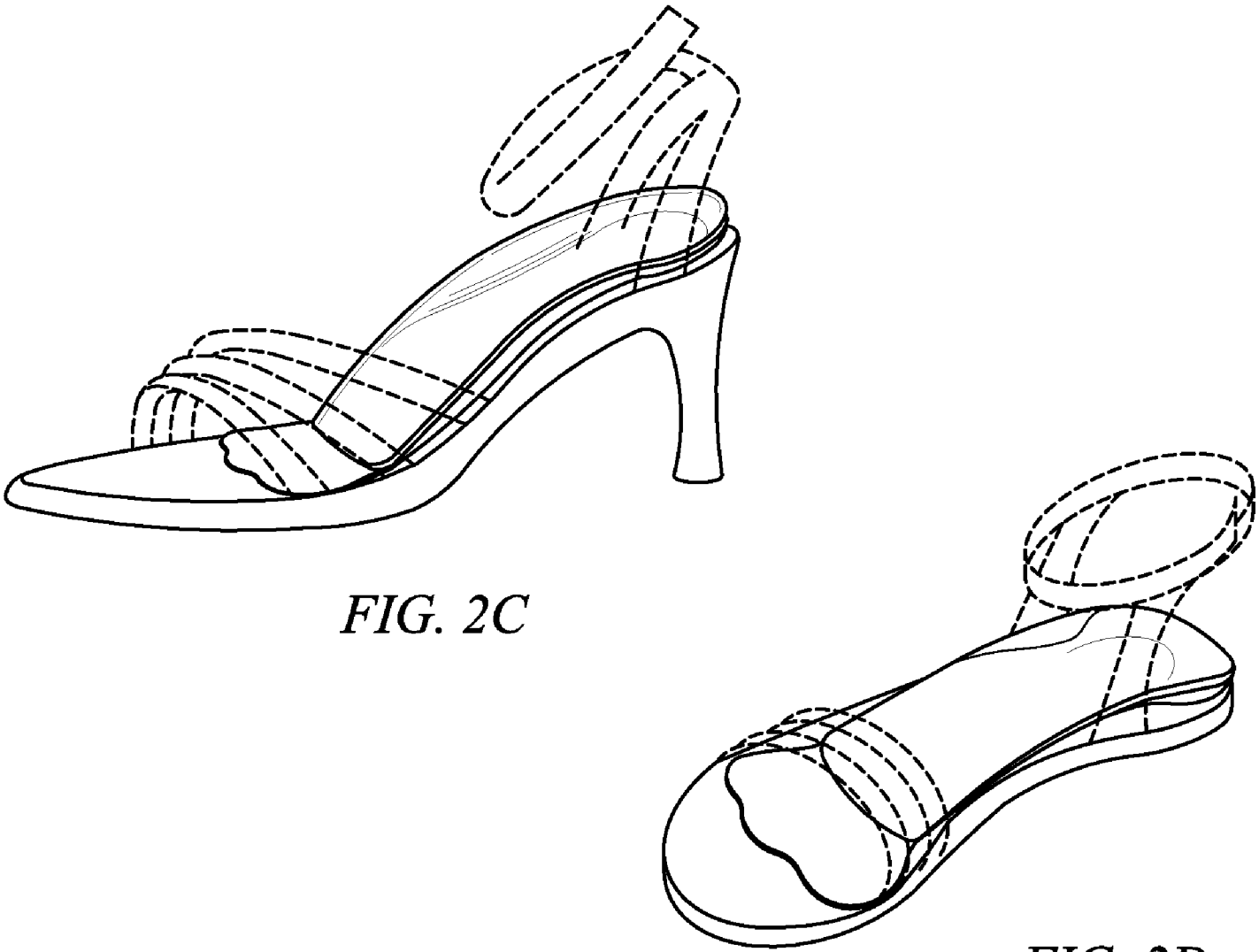
FIG. 2C shows an orthotic device of the invention used in an open high-heel shoe.
FIG. 2D shows an orthotic device of the invention used in an open flat sandal shoe.

FIG. 2C shows the use of an orthotic device of the invention in an open high-heel shoe.

FIG. 2D shows the use of an orthotic device of the invention in an open flat sandal shoe.

For the top layer of the high-heel design, there may be an increased thickness over the above-mentioned current thickness of the medial arch area to support the increased arch height that occurs anatomically when wearing a heel.

For the middle layer of the high-heel design, the heel bed may be elongated to provide more of a platform for the calcaneus for support in the horizontal position. There may be an increased angle from the horizontal plane where the rear foot rests to the slope of the midfoot to accommodate for the anatomical changes that occur in the foot when plantar flexed at an angle of a high heel from 1.5 inches to 3 inches.

As for the orthotic device discussed above, in an implementation, the entire high-heel orthotic supportive device may be translucent or clear. This is especially desirable for open shoes because any colors or opaque materials would be more visible to others, which the user would generally not want. There may also be two or more different thicknesses for people in weight categories.

Figure 2E:
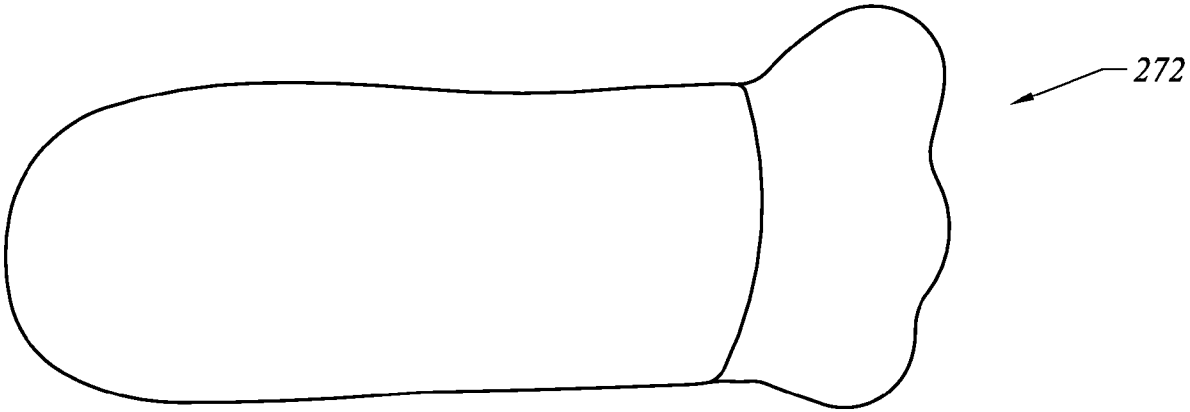
FIG. 2E shows a first design of an orthotic device with scalloped edging.
Figure 2F:
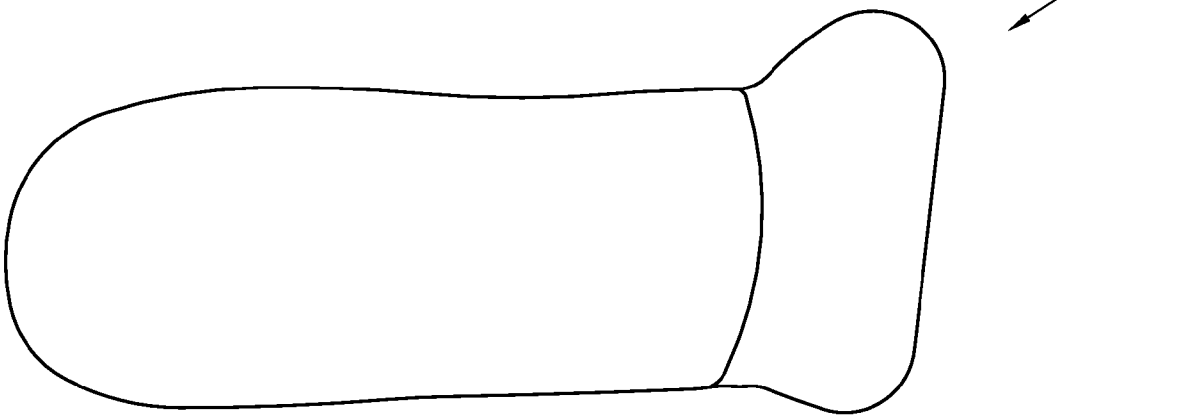
FIG. 2F shows a second design of an orthotic device with smooth edging.

There may be different variations of an orthotic device of the invention. The top layer may be different for men and women, or people of different weights. For example, FIG. 2E shows one design that may be used, for example, for women. FIG. 2F shows one design that may be used, for example, for men. Comparing the two designs, a front edge 272 of the design in 2E has scalloping while a front edge 274 of the design in FIG. 2F does not. These orthotic devices function similarly.

Furthermore, for example, in an implementation, the women's design will have two different thicknesses in the middle layer, one design for women under 150 pounds and one which is thicker for women over 150 pounds (or other specified weight). There may be any number of different orthotic device thicknesses based on weight ranges.

In a specific implementation, the support zones of the insole are the same as for the insole in FIG. 4.

Heel Lift Device

Figure 5A:
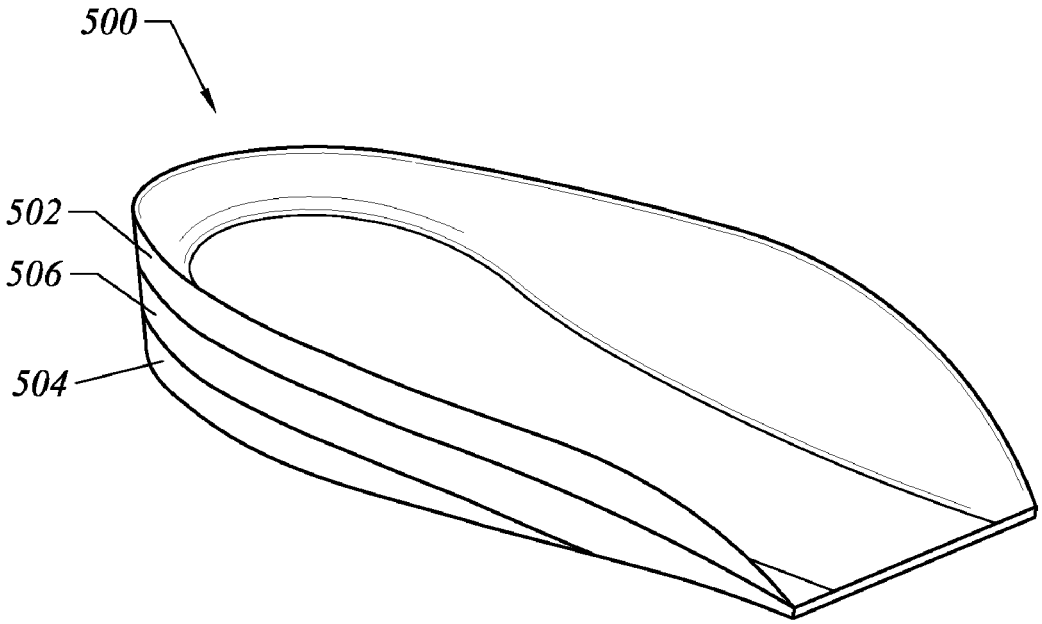
FIG. 5A shows an adjustable heel lift in accordance with the present invention.

FIG. 5A shows an adjustable heel lift 500 with upper layer 502 and lower layers 504 and 506. The lower layers are removable so a user can vary the amount of lift by selecting a specific number of layers to include in the heel lift. The top or upper layer may be formed from a cushioning material. In an implementation, the top layer combines the use of a heel lift with a heel cup to cradle and add support to the heel, the heel cup provides medial and lateral support to the heel, with additional support to the calcaneus to assist in pronation control.

Figure 5B:
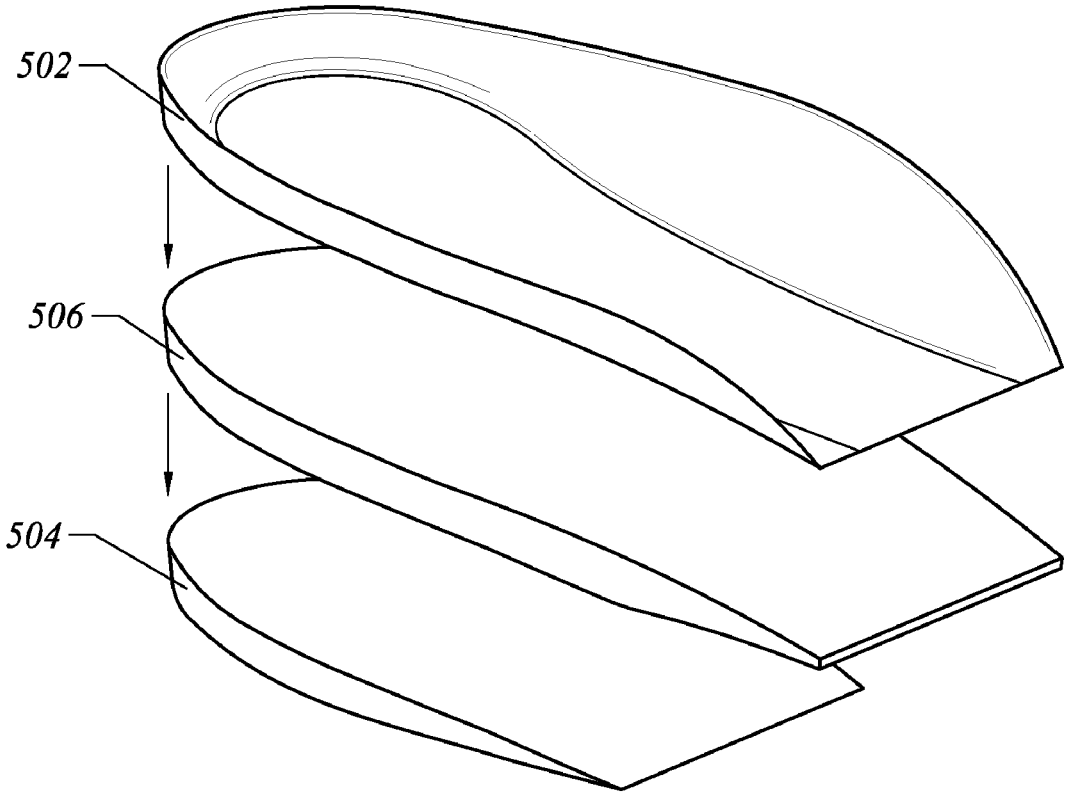
FIG. 5B shows the different layers of the adjustable heel lift in accordance with the present invention.

FIG. 5B shows how layers 502, 504, and 506 may be separated from each other. There can be any number of lift layers, more or fewer than the number shown. For example, there may be two, three, four, five, six, seven, eight, or more removable lift layers. Each layer may provide the same amount of lift or varying thicknesses of lift. Either some or all of the removable layers can be removed from (or added to) the upper layer in order to provide the appropriate amount of heel lift desired by the user.

In an implementation, the layers made of a material having adhesive properties or include an adhesive between them that allows repeated removal and reapplication such that the removable layers can be selectively used singularly or in combination to provide an appropriate amount of lift for each specific user.

In an implementation, layers 502, 504 and 506 are formed of a viscoelastic polymer with inherent adhesive or tacky property, so each layer can be added or removed (e.g., peeled off) as desired to vary the amount of lift.

In an implementation, the bottom layer of the heel life may be made of a viscoelastic polymer with an inherent adhesive or tacky property that allows the heel lift to be removably attached within a shoe, such as an open shoe. The layers between the top layer and bottom layer may or may not be the same viscoelastic polymer with an inherent adhesive or tacky property.

If the top layer is composed of two layers: the two layers will be permanently adhered together. The top layer is composed of a semiflexible polymer. The bottom is the same viscoelastic material as the bottom two layers. And the device is clear or translucent.

The layers may be composed of a viscoelastic polymer with an inherent adhesive property which allows the layers to adhere together as well as allowing the lift to adhere to the top surface of the shoe bed to stay in place in an open shoe, sandal, or in a closed shoe. The device will stay in place in an open shoe by virtue of its adhesive property and removed without damage to the shoe. Because the adhesive property is inherent within the material it can be reused throughout the life of the device, the adhesive property will not wear off.

If the top layer is composed of one layer, it is composed of a viscoelastic polymer. There is a coating over the viscoelastic surface to decrease the tacky surface which comes in contact with the foot. There is shock absorption via the viscoelastic properties inherent in the material.

Figure 5C:
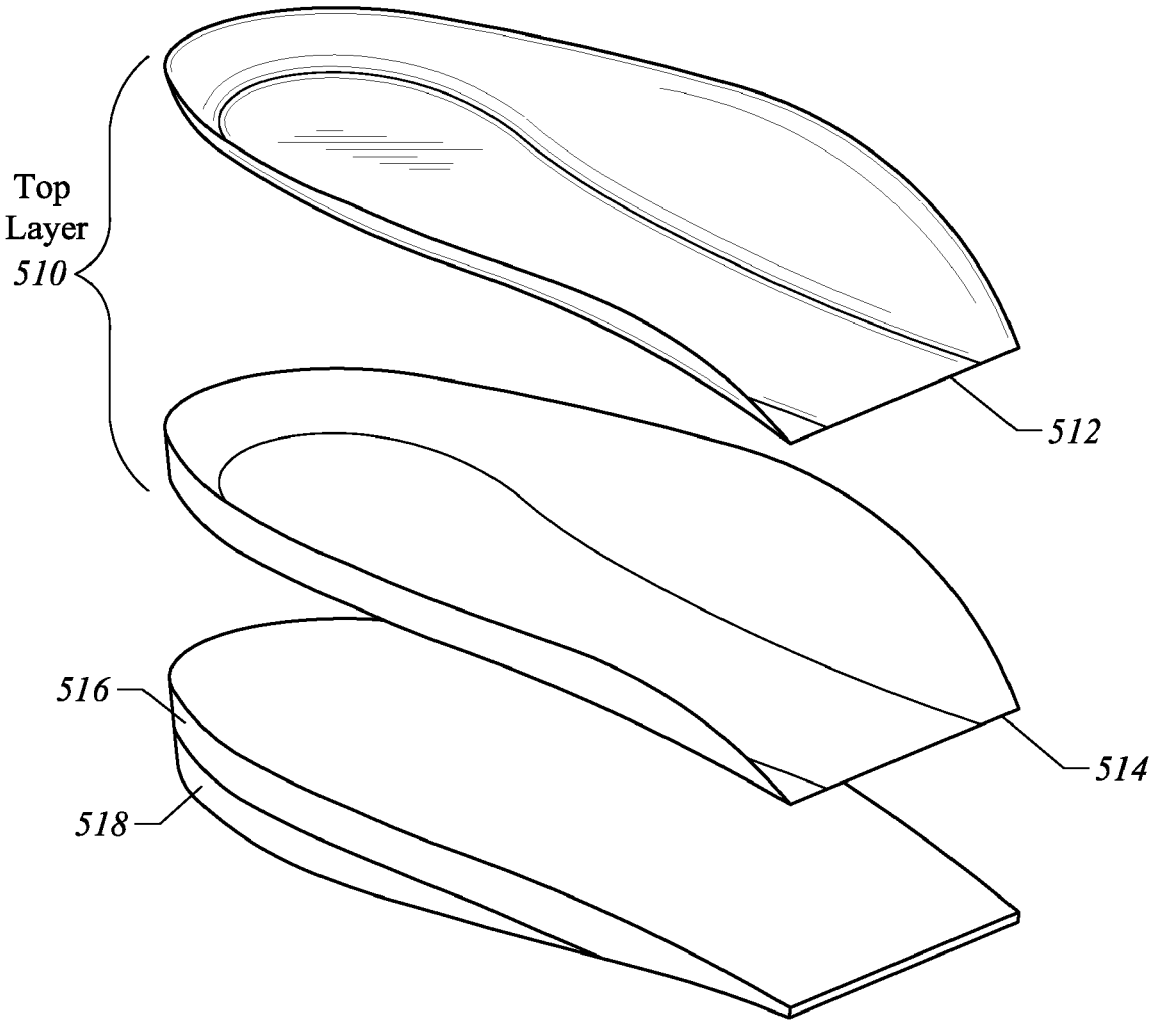
FIG. 5C shows another adjustable heel lift implementation.

FIG. 5C shows another adjustable heel lift implementation. In this implementation, a top layer 510 of the heel lift is formed from two different layers 512 and 514 permanently bonded together. A top layer 512 of the two layers that are permanently bonded together is made of a semiflexible polymer while a bottom layer 514 of the two layers is made of a viscoelastic polymer. Additionally, the bottom two layers 516 and 518 are also made of a viscoelastic polymer with adhesive properties.

Flat Cushion Device

Figure 7A:
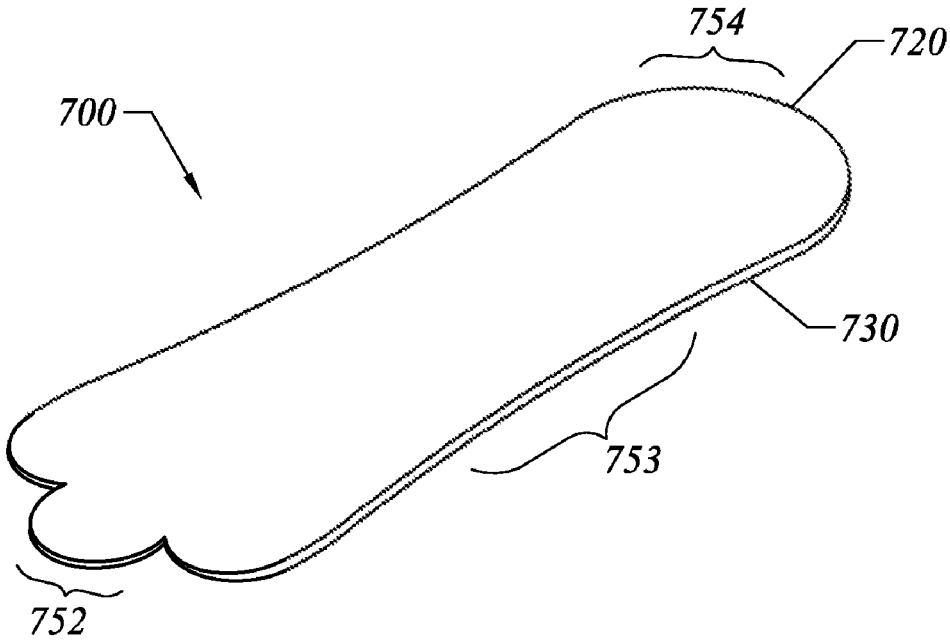
FIG. 7A shows a perspective view of a cushioning insole in accordance with the present invention.
Figure 7B:
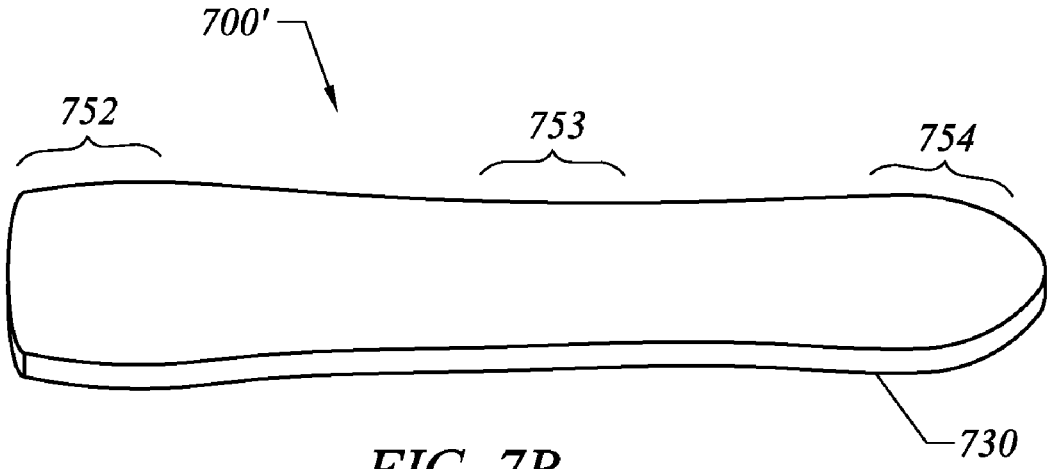
FIG. 7B shows a partial cross-sectional view of a cushioning insole in accordance with the present invention.

A flat sole pad cushioning insole is presented in FIGS. 7A and 7B. Flat sole pad cushioning insoles 700 and 700' include two layers, a top cushioning layer 720 includes a soft polymer and a bottom adhesive layer comprised of a viscoelastic polymer 730. Like the supporting insoles discussed above, cushioning insole 700 is designed for use within open shoes. Cushioning insoles 700 and 700' may provide a substantially noncontoured upper surface adapted to receive a wearer's foot and includes three regions shaped according to corresponding anatomy of a foot.

The various regions of cushioning insole 700 and 700' have widths selected according to typical foot dimensions corresponding to an insole size. Each insole is shaped to fit within the footprint interface between a foot and a shoe, which is the surface along which the foot and the foot bed of a shoe touch. Specifically, the shape of a heel region 754 is selected to fall within the surface of interface between the heel portion of the plantar region of a shoe. A mid foot region 753 is narrower than heel region 754 and its shape is selected to fall within the surface of interface between the mid foot portion of the plantar region of a foot and a shoe. A forefoot region 752 is wider than heel region 754 and its shape is selected to fall within the surface of interface between the forefoot portion of a wearer's foot and an open shoe.

Upper layers 720 and 700' of the insoles provide a comfortable interface with the skin of a wearer's foot. The bottom layer 730 is adhesive due to the properties of the viscoelastic material and allows the device to stay in place. When the cushioning insole is mounted on a shoe, the lower surface adheres to the shoe's foot bed and remains in place, regardless of whether the shoe is being worn, until removal. Once the cushioning insole is not desired, or otherwise needs to be removed, it can be peeled from the foot bed of the shoe, releasing the reusable adhesive on the bottom layer from the foot bed surface. The reusable adhesive properties of the bottom layer is retained for future use in the same or another shoe.

The upper or top surface of the cushioning insole presents a comfortable, interface with the wearer's foot. In an embodiment, the top surface includes bumps formed into a particular pattern such as a decorative flower-like pattern. In other embodiments, bumps may or may not be included. In some embodiments the bumps are included in an abstract or nondecorative pattern. The bumps, when included, are configured to provide a grippy texture. Further, in some embodiments, the front edge of the insole is integrated into the decorative pattern. Thus, the insole truncates at the forefoot region of a wearer's foot. The device is clear and translucent. In another embodiment there is only one layer this layer is made of a viscoelastic polymer with a thin coating on top to decrease the tackiness on the contact surface with the foot.

In contrast, insole 700' may or may not extend beneath the toes. In an embodiment, insole 700' does not include bumps or a decorative pattern, though in other embodiments bumps are provided. There is an option of an adding a top fabric decorative layer.

Cushioning insoles 700 and 700' provide substantially the same level of support and cushioning to each region of a wearer's foot. That is, they substantially transmit support provided by the foot bed of the shoe upon which it is mounted and provides additional cushioning, while remaining essentially neutral with regard to support. Clearly, the specific dimensions of any insole will vary according to the shoe size and width for which it is designed.

In an specific embodiment of a comfort sole liner according to the invention, there will be a layer of viscoelastic material of a consistent thickness to cushion the sole of the foot and absorb shock during loading. A coating is applied to a top side (i.e., side contacting the foot) of the viscoelastic material to decrease the tackiness of the surface that comes in contact with the sole of the foot. However, the bottom surface of the comfort sole line will retain its regular tackiness, so it will adhere to the shoe.

Contoured Cushioned Device with Minimal Cushioning Support

Figure 8:
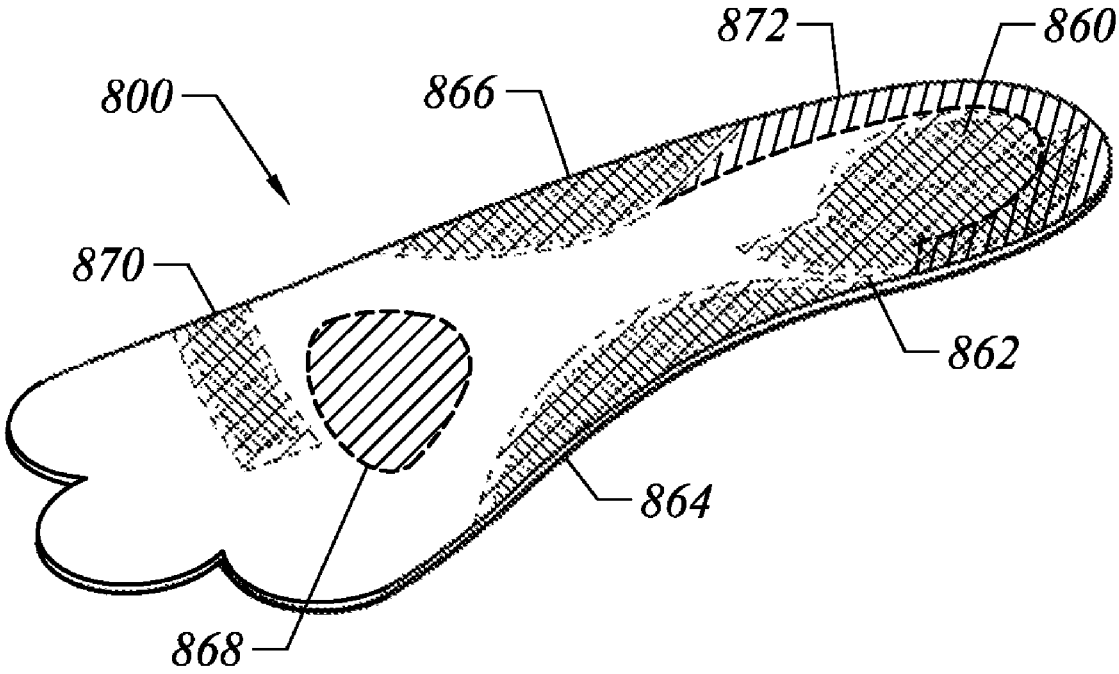
FIG. 8 shows a contoured sole pad according to an embodiment of the present invention.

Further embodiments of the present invention include other types of two layered systems providing varying degrees of cushioning to different aspects of the sole of the foot. In one embodiment, a contoured sole pad, as shown in FIG. 8, provides different degrees of cushioning to different regions of the foot. The contoured sole pad 800 includes the areas of increased thickness as described in relation to the upper layer 220, shown in FIG. 2A and discussed above.

Specifically, contoured sole pad 800 includes a heel area 860 of increased thickness, an area 862 of increased thickness on the medial aspect of the heel, a medial arch support area 864 of increased thickness, a lateral arch support area 866 of increased thickness, a pad area 868 of increased thickness, and an area 870 of increased thickness under the metatarsal heads. In addition, the contoured sole pad also includes a heel pad area 872 of increased thickness to cup the heel of the user.

Areas 860, 862, 864, 866, 868, 870, and 872 of increased thickness are thicker than the remainder of the contoured sole pad 800. In different embodiments, this thickness ranges from about 0.5 millimeters to about 3.5 millimeters. Also, in some embodiments, the outer edges of areas 860, 862, 864, 866, 868, 870 and 872 are slightly less thick than the center of the areas, such that areas 860, 862, 864, 866, 868, 870 and 872 gradually ramp up to the maximum thickness.

In some embodiments, the insole is contoured to be relatively thicker under the medial and lateral arch regions of the foot with or without a softer area under the heel of the foot.

In some embodiments, the contoured sole pad 800 presents a comfortable interface with the wearer's foot and includes bumps formed into a decorative flower-like or other pattern. In other embodiments, bumps may or may not be included, and in some embodiments are included in an abstract or nondecorative pattern.

A lower layer or bottom surface of the contoured sole pad is made of a viscoelastic polymer with inherent adhesive properties to interface with the foot bed of a shoe. When the contoured sole pad is mounted on a shoe, the lower layer adheres to the foot bed of the shoe and remains in place, regardless of whether the shoe is being worn, until removal. Once the contoured sole pad is not desired, or otherwise needs to be removed, it can be peeled from the foot bed of the shoe. The inherent adhesive property of the viscoelastic material allows the device to be reused in the future.

A contoured sole pad similar to the one in FIG. 8 may be used for heeled shoes. The areas of the contoured sole pad for heeled shoes are the same as the pad shown in FIG. 8A.

In a specific implementation, a contoured sole has an adhesive property inherent within the material allows the device to adhere to the top surface of the shoe and stay in place in an open, sandal, or closed shoe. The adhesive property of the material allows it to be reapplied to different shoes or sandals throughout the life of the device without losing the adhesive ability The viscoelastic material which reduces shock cushions and provides support to the foot. There are varying degrees of thickness throughout the pad offering support and or cushioning to the foot. There is a heel cup area to cradle and support the heel of the foot. There is additional support in the medial aspect of the heel area to assist in supporting the calcareous which reduces pronatory forces. There is a raised area in the medial arch to provide cushioning and support for the medial arch. There is a raised area in the lateral arch to provide cushioning and support for the lateral arch. There is a raised area which creates a metatarsal pad area to support, cushion, and shift loads on the ball of the foot.

There is a raised area under the heads of the outer three metatarsals to assist in shifting loads on the ball of the foot. The combination of both the metatarsal pad and the pad under the outer three metatarsal heads assist in decreasing weight bearing on the first two metatarsals. The combination of all of the contoured areas shift loads on the foot to assist in normal alignment. Another embodiment has one layer only comprised of a viscoelastic material with a thin coating of material on the top of the viscoelastic material to decrease the tackiness of the vicsoelastic material which comes in contact with the foot. All embodiments have the option of an additional top fabric layer.

Figure 9:
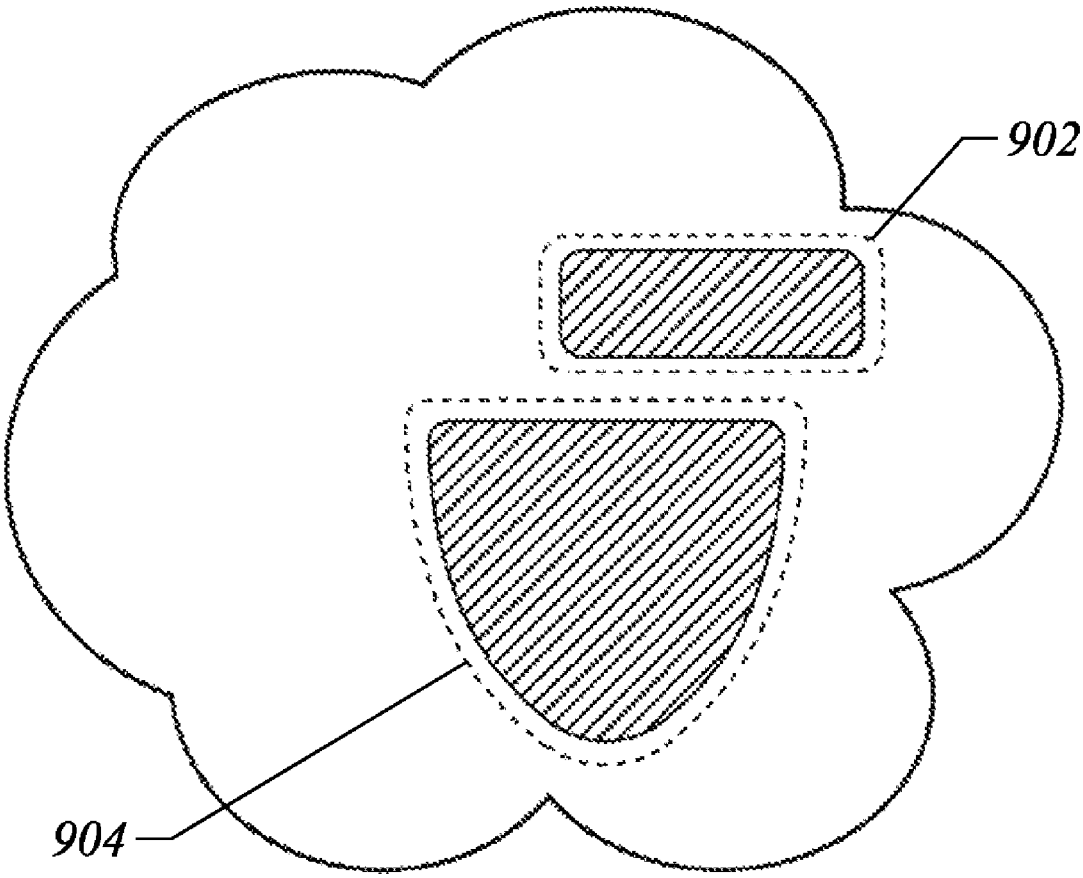
FIG. 9 shows a ball of the foot pad for flat shoes according to an embodiment of the present invention.

An embodiment of a ball of the foot pad is shown in FIG. 9. A ball of the foot pad 900 for flat shoes is shown in FIG. 9. A ball of the foot pad may also be used for heeled shoes. The ball of the foot pad is shaped to cushion the ball of the foot only. The ball of the foot pad, an area 902 of increased thickness is included under the heads of the third through fifth metatarsal heads. For the ball of the foot pad, there is an area 904 of increased thickness is included under the distal metatarsal shaft region of the foot in the shape of a metatarsal pad.

The ball of the foot pad may be composed of an adhesive-type reuseable viscoelastic polymer material for removing and reapplying the ball of the foot pads.

In a specific implementation of the ball of the foot pad, there is cushioning to the ball of the foot via a viscoelastic material. There is a raised area in the shape of a metatarsal pad to cushion and shift loads on the ball of the foot. There is a raised area in the shape of a rectangle which is located under the lateral three metatarsal heads of the foot. The combination of both of the raised areas create a shift in the loading forces on the ball of the foot resulting in reducing loads on the first and second metatarsal heads. There is a coating on top of the viscoelastic material to decrease the tackiness of the viscoelastic material which comes in contact with the foot.

Heel Spur Pad Device

Figure 10A:
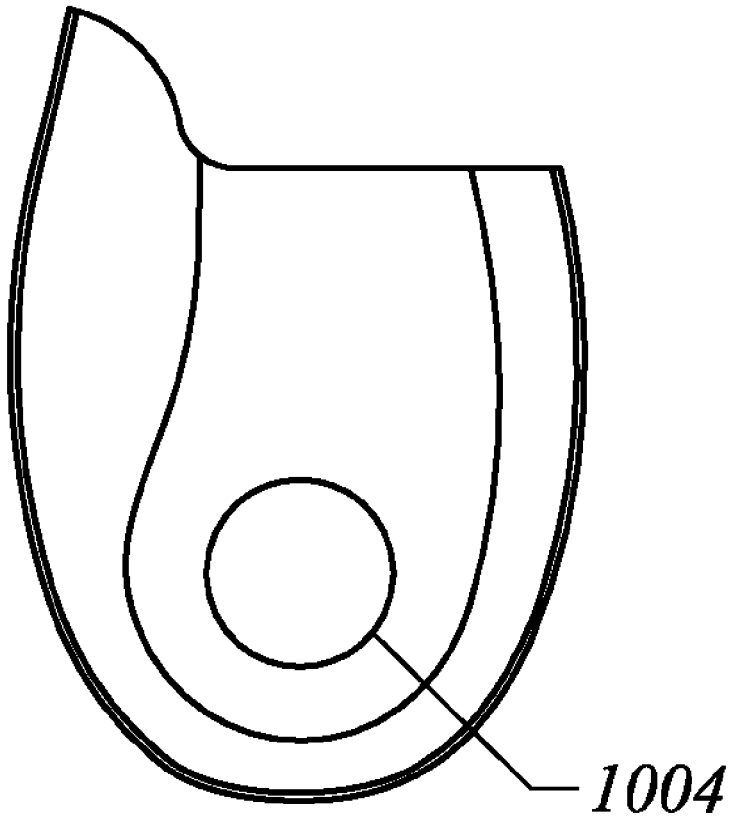
FIG. 10A shows an upper view of a heel spur pad according to an alternate embodiment of the present invention.
Figure 10B:
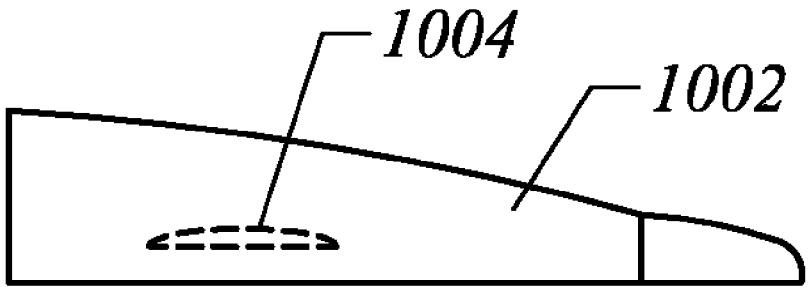
FIG. 10B shows a cross-sectional view of a heel spur pad according to an alternate embodiment of the present invention.

An embodiment of a heel spur pad is shown in FIGS. 10A and 10B. A top view of the heel spur pad 1000 is shown in FIG. 10A. A cross-sectional view of the heel spur pad 1000 is shown in FIG. 10B. The heel spur pad includes an angled wedge with a pad area of softer material. There is a heel cup to cradle the heel of the foot to provide support and cushioning to the rear foot. There is a medial extension of the device to assist in providing support of the calcaneous and rear foot to minimize pronatory forces. There may or may not be a softer durometer of the viscoelastic material within the heel area strategically placed to further cushion the medial plantar aspect of the calcaneus.

The angled wedge and the pad area are formed of a soft polymer material. Within the pad area there is a softer durometer area than the wedge layer to further cushion the calcaneal spur area. In some embodiments, the top layer of the heel spur pad is composed of a soft polymer material and there is a bottom layer made of a viscoelastic polymer with adhesive properties for removing and reapplying the heel spur pad. In some embodiments there is only one layer which is made of a viscoelastic polymer with adhesive type properties. Embodiments may have a thin coating on the top to decrease the tackiness of the surface area that comes in contact with the foot. All embodiments have the option of an additional top fabric decorative layer.

This is made of a viscoelastic polymer with adhesive properties inherent within the material which allows the device to adhere to the top of the sole of an open or closed shoe and stay in place the device can be reapplied to another shoe or sandal without damage to the shoe. The device may be clear or translucent.

The adhesive property of the material allows the device to be used in both an open or sandal type shoe as well as a closed shoe. The viscoelastic property of the material also provides shock absorption of loading forces on the plantar surface of the heel. There is a coating on top of the viscoelastic material to decrease the tackiness of the viscoelastic material which comes in contact with the foot.

Figure 11:
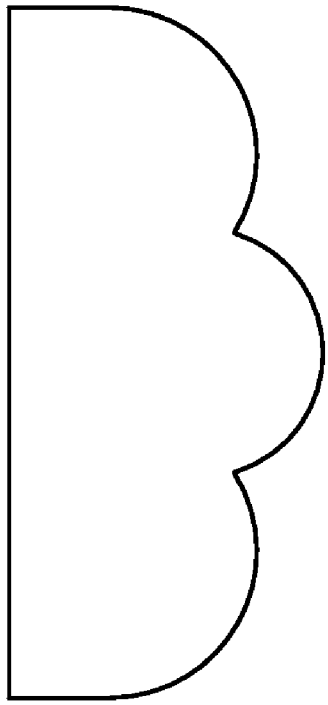
FIG. 11 shows a medial arch piece for an orthotic device of the invention.

FIG. 11 shows a medial arch piece. In an embodiment of the invention, there may be additional medial arch support pieces for the orthotic device as shown. These additional pieces may be part of a kit which includes right and left arch support pair and a number of medial arch support pieces.

There is the ability of additional layers of medial support made of a viscoelastic material to be placed on the medial side of the arch support to provide additional support. These pieces will stay in place via the adhesive property of the material and be able to be repositioned as needed without losing the adhesive property.

Figure 12:
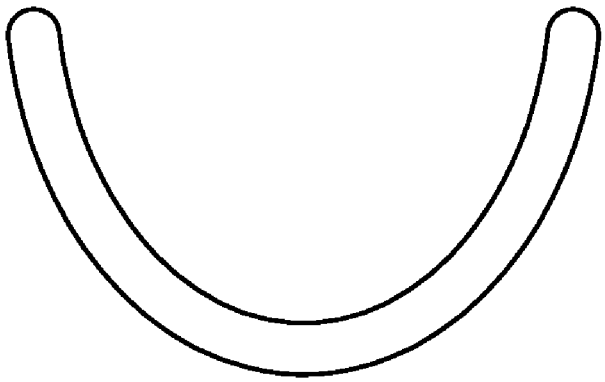
FIG. 12 shows a heel cup piece for an orthotic device of the invention.

FIG. 12 shows a heel cup piece. In an embodiment of the invention, there may be additional heel cup pieces for the orthotic device as shown. These additional pieces may be part of a kit which includes right and left arch support pair and a heel cup piece.

There is the ability to apply an additional layer of viscoelastic material shaped to contour to the inside rim of the heel cup to provide additional support to the heel with individuals with a narrow heel. These pieces will stay in place via the adhesive property of the material and be able to be repositioned as needed without losing the adhesive property.

FIGS. 13-35 show various views of three specific designs of the invention.

Figure 13:
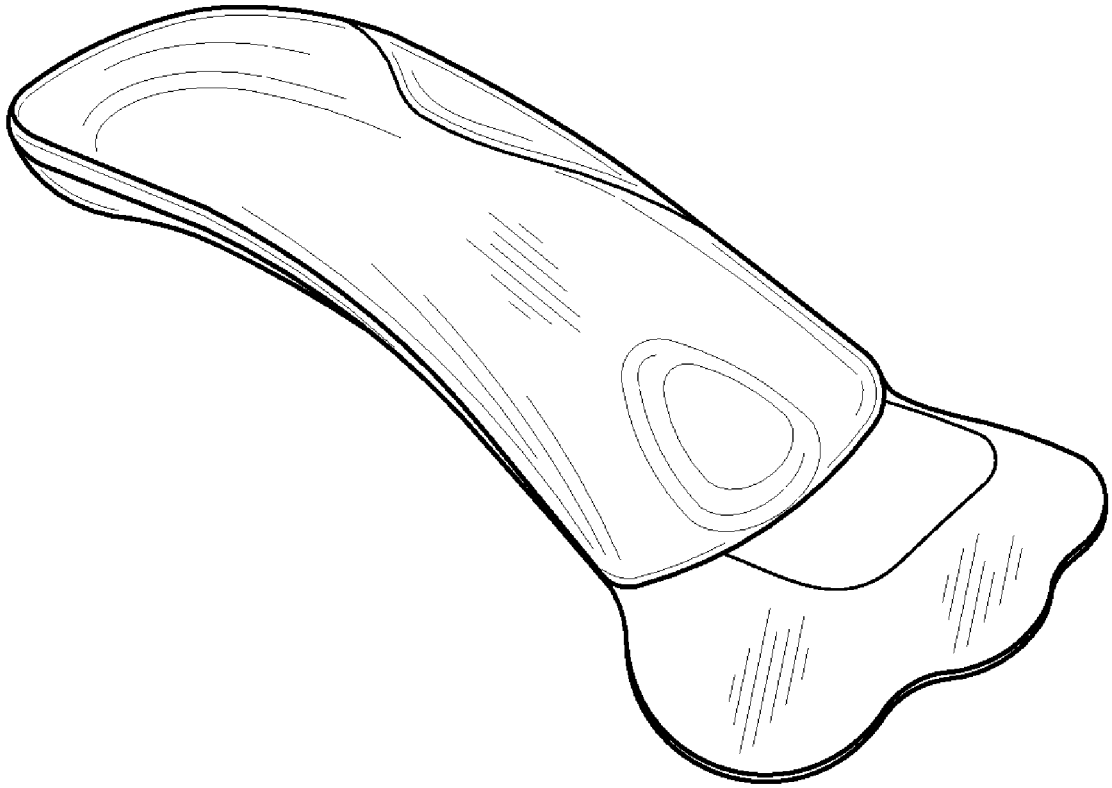
FIGS. 13-35 show various views of three specific designs of the invention.

FIG. 13 shows a perspective view of a first embodiment of a design for an orthotic device.

Figure 14:
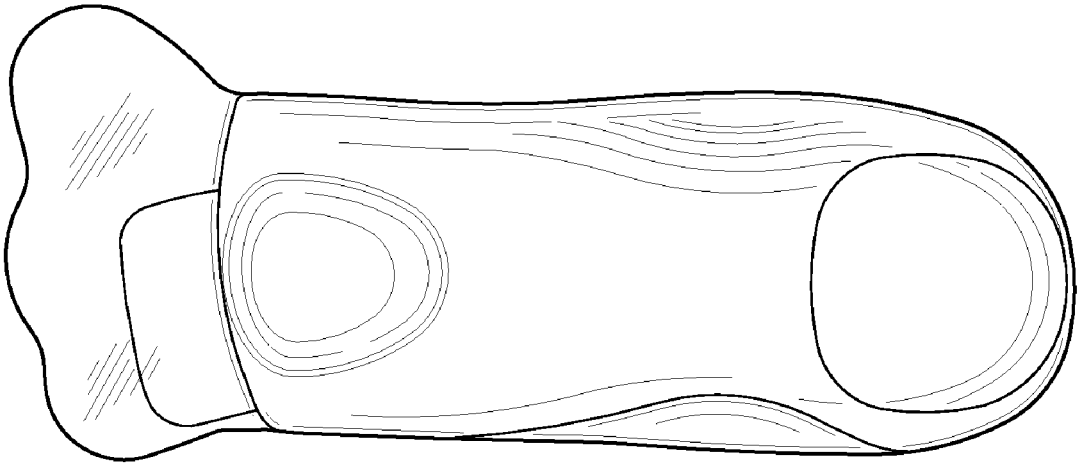

FIG. 14 shows a top view of the first embodiment.

Figure 15:
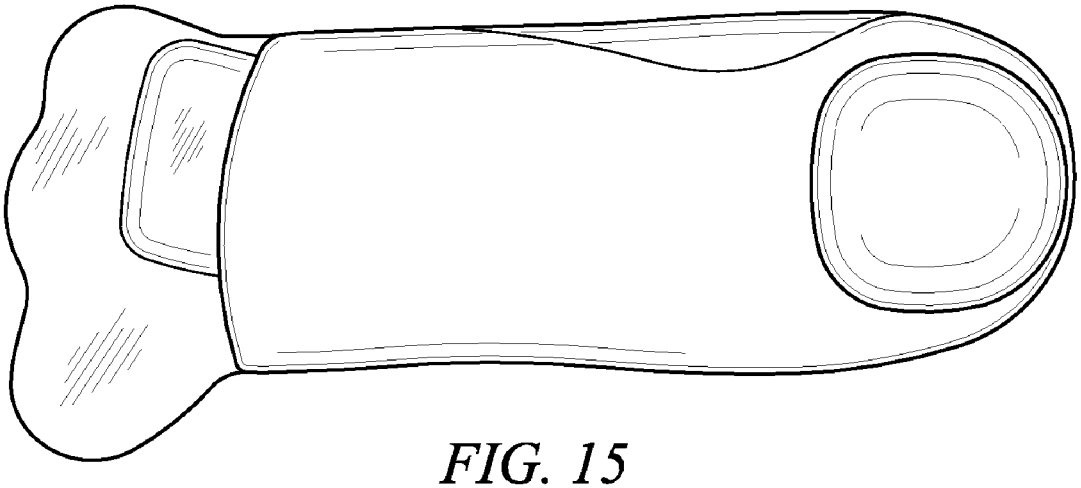

FIG. 15 shows a bottom view of the first embodiment.

Figure 16:
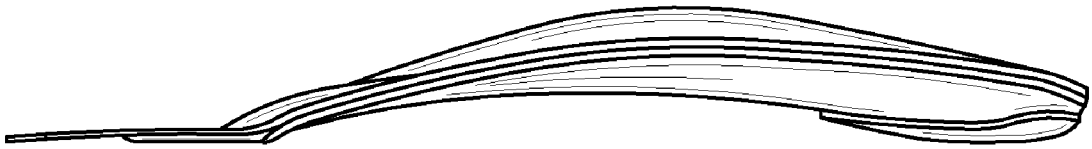

FIG. 16 shows a right-side view of the first embodiment.

Figure 17:
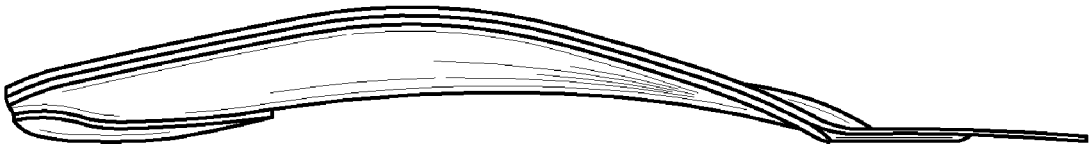

FIG. 17 shows a left-side view of the first embodiment.

Figure 18:
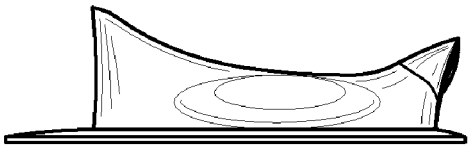

FIG. 18 shows a front view of the first embodiment.

Figure 19:
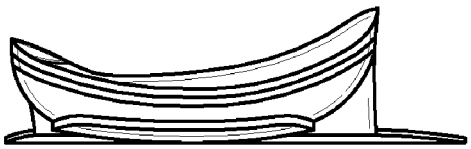

FIG. 19 shows a back view of the first embodiment.

Figure 20:
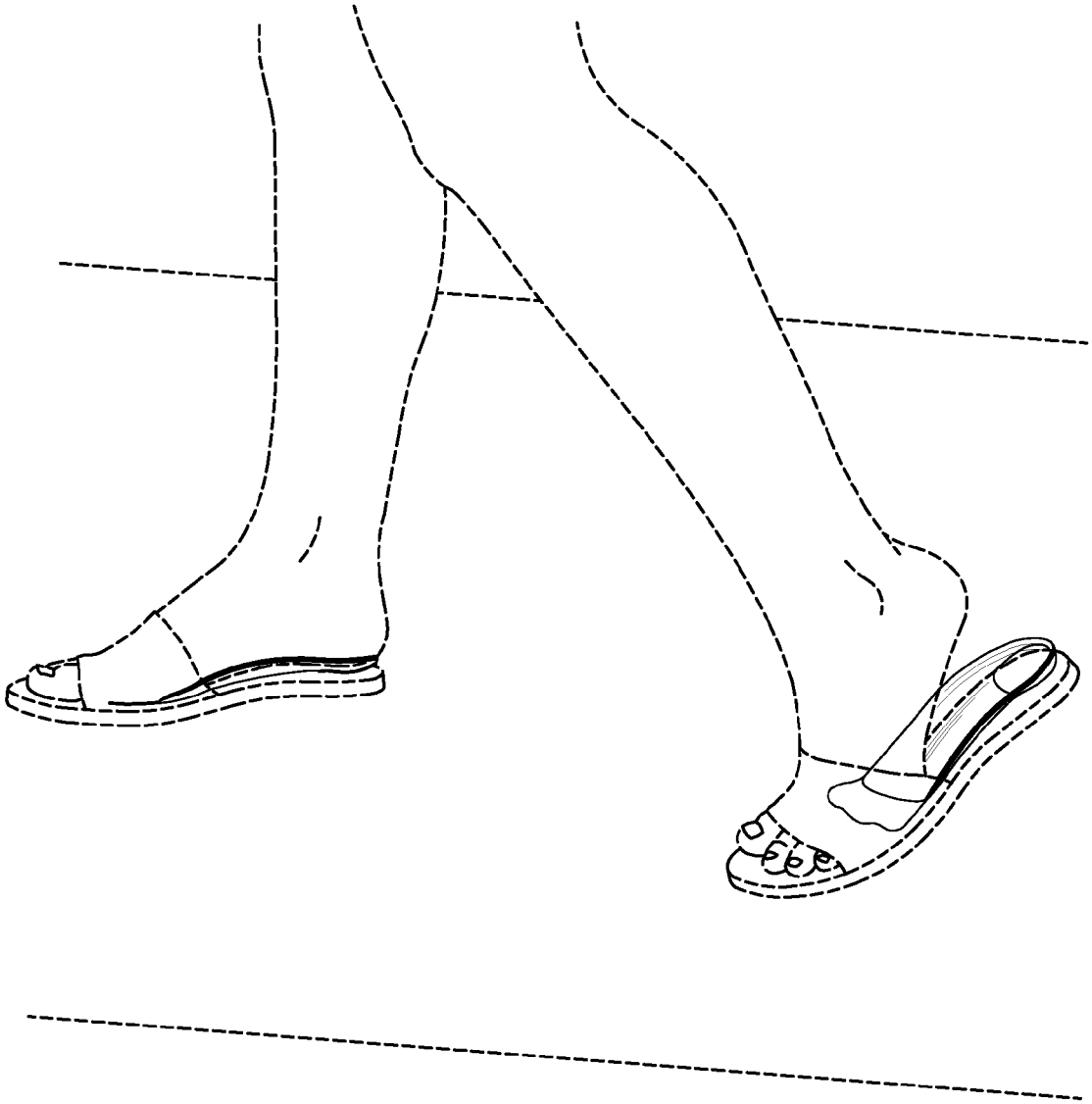

FIG. 20 shows a view of the first embodiment of the orthotic device when used in a left-side open flat shoe. Note how the orthotic device stays in place, sticking to or staying in place on the shoe, even when a person is walking or running.

Figure 21:
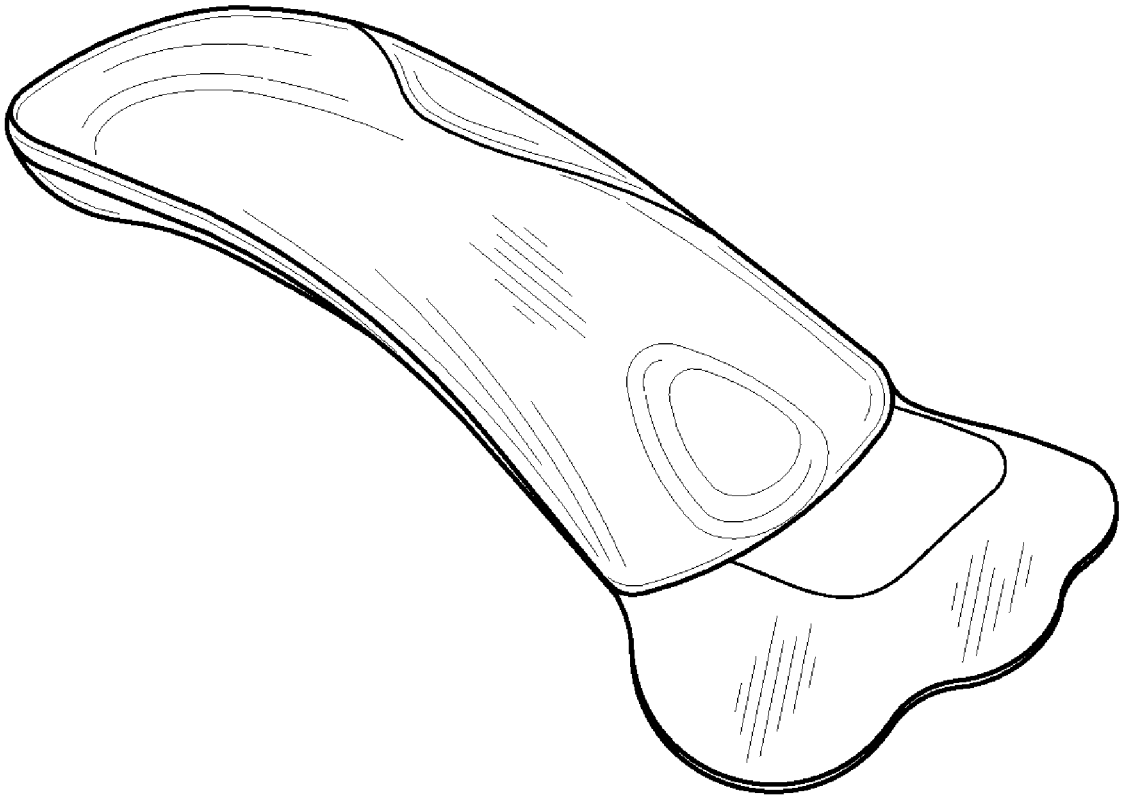

FIG. 21 shows a perspective view of a second embodiment of a design for an orthotic device.

Figure 22:
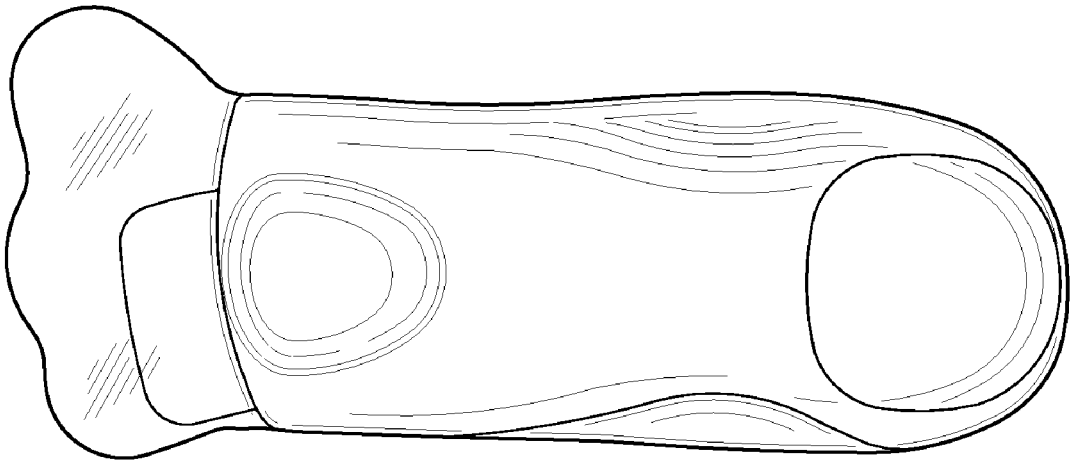

FIG. 22 shows a top view of the second embodiment.

Figure 23:
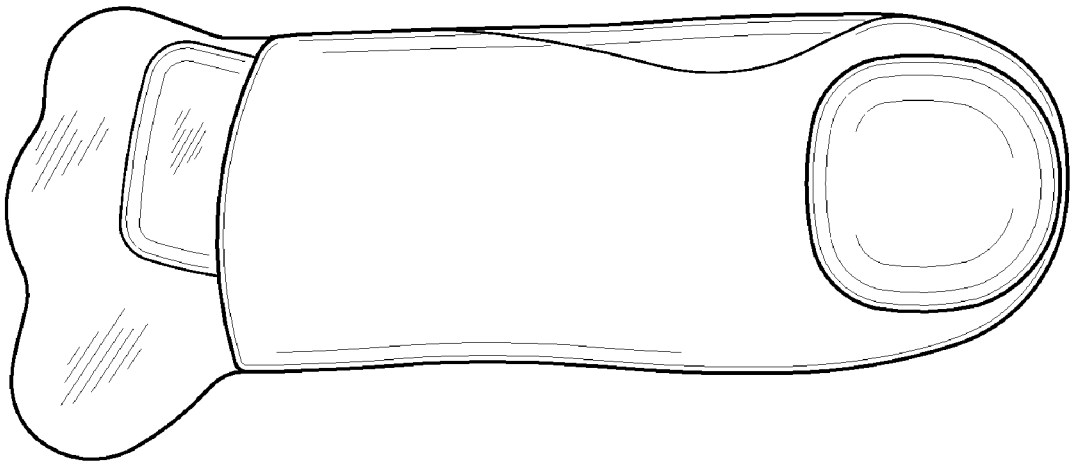

FIG. 23 shows a bottom view of the second embodiment.

Figure 24:
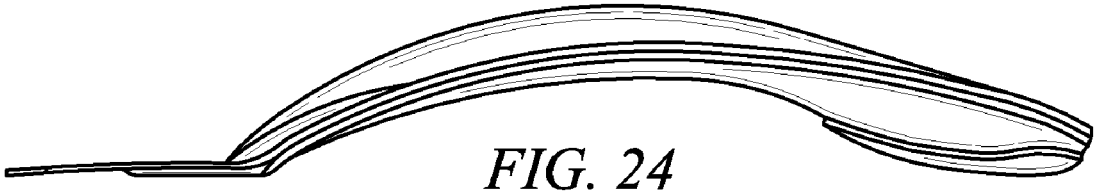

FIG. 24 shows a right-side view of the second embodiment.

Figure 25:
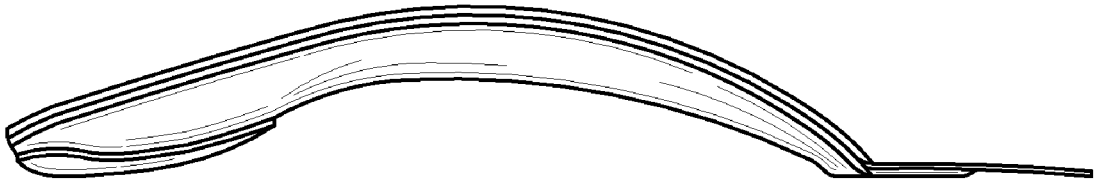

FIG. 25 shows a left-side view of the second embodiment.

Figure 26:
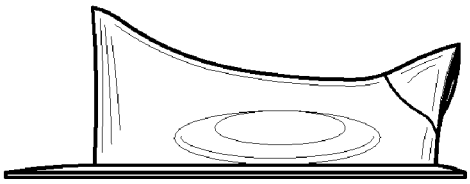

FIG. 26 shows a front view of the second embodiment.

Figure 27:
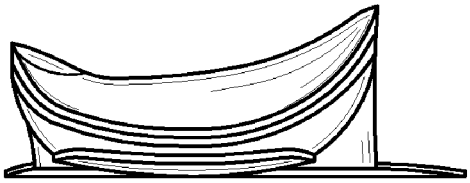

FIG. 27 shows a back view of the second embodiment.

Figure 28:
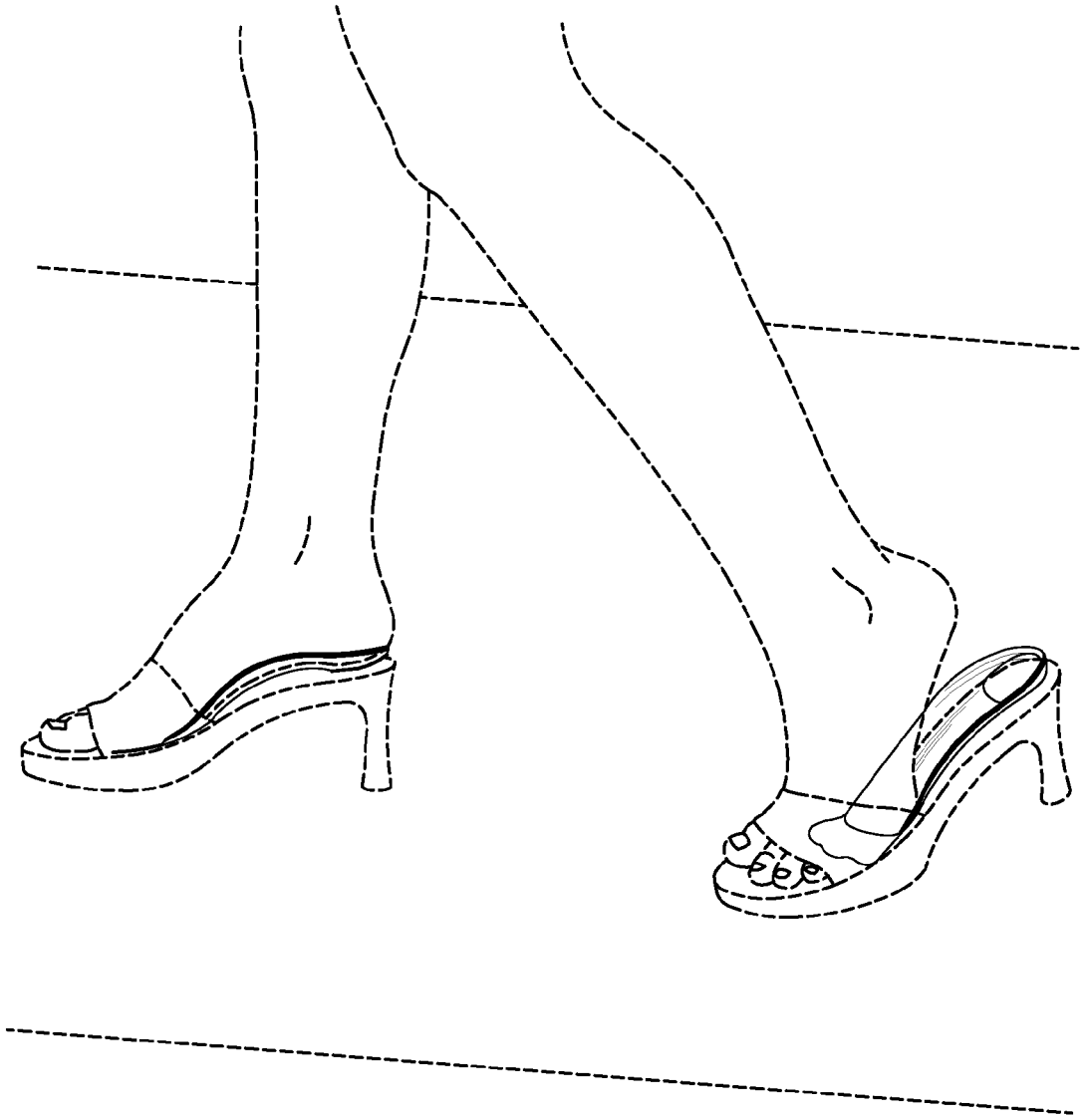

FIG. 28 shows a view of the second embodiment of the orthotic device when used in a left-side open heeled shoe.

Figure 29:
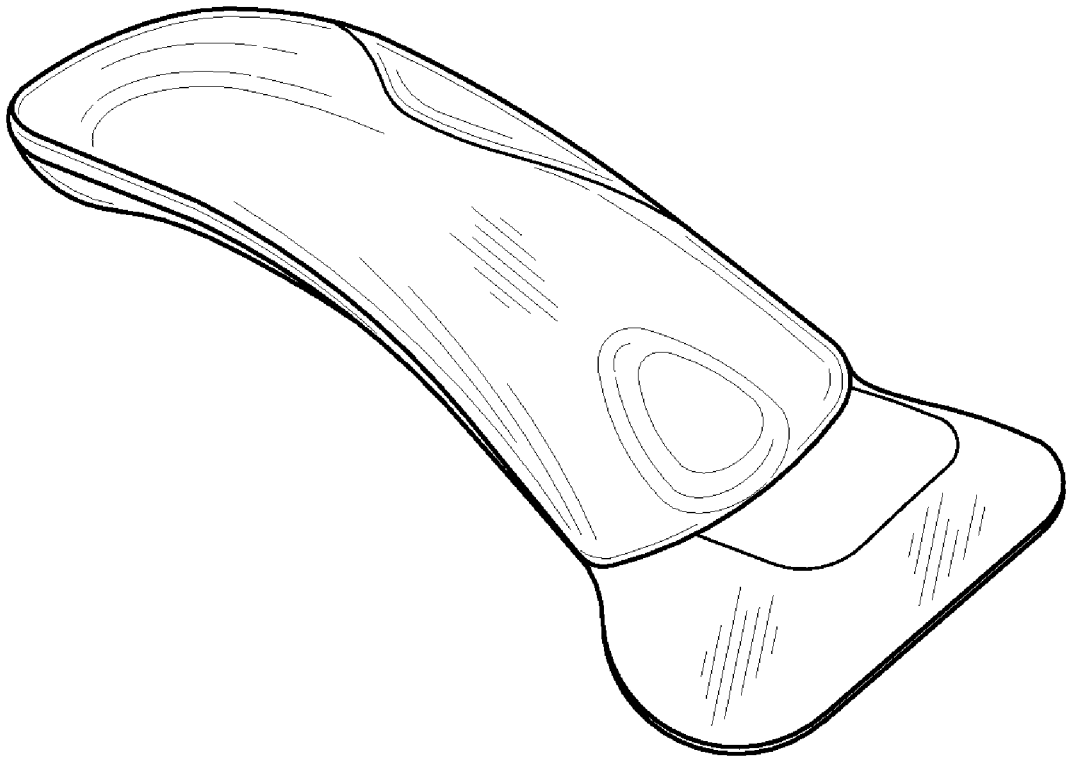

FIG. 29 shows a perspective view of a third embodiment of a design for an orthotic device.

Figure 30:
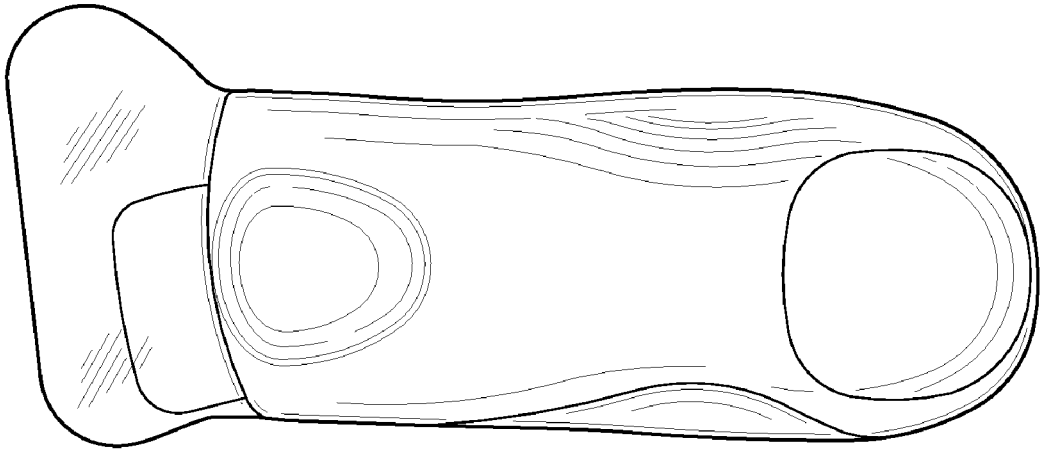

FIG. 30 shows a top view of the third embodiment.

Figure 31:
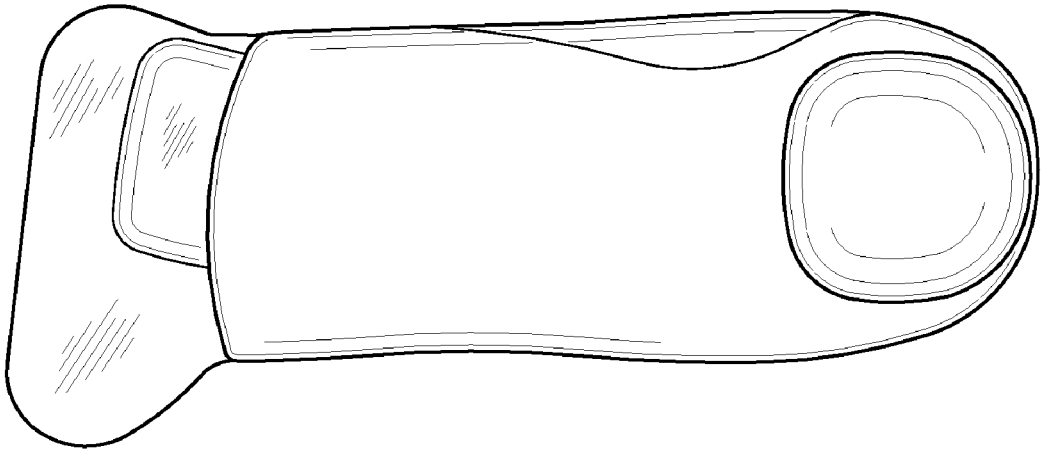

FIG. 31 shows a bottom view of the third embodiment.

Figure 32:
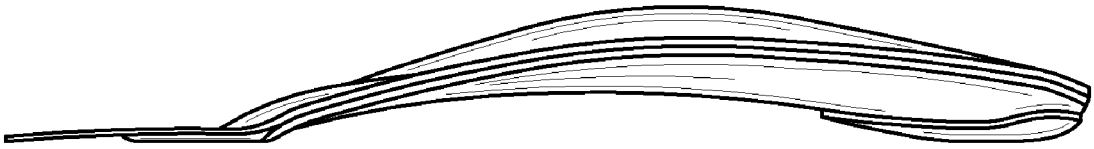

FIG. 32 shows a right-side view of the third embodiment.

Figure 33:
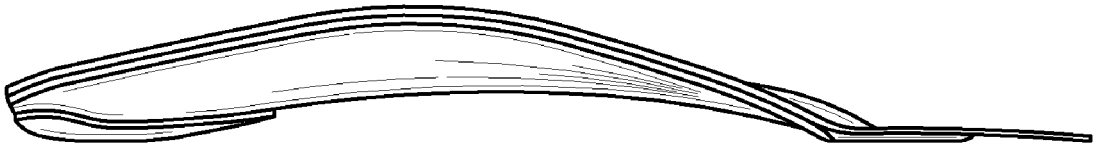

FIG. 33 shows a left-side view of the third embodiment.

Figure 34:
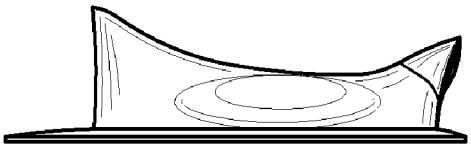

FIG. 34 shows a front view of the third embodiment.

Figure 35:
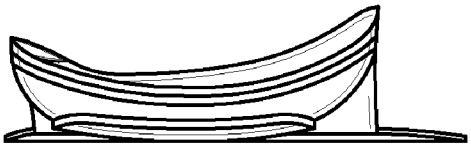

FIG. 35 shows a back view of the third embodiment.

The views shown in FIGS. 13-35 are for an orthotic device for use with a left-side shoe or left foot. Views for an orthotic device for use with a right-side shoe or right foot are mirror images of the above views.

General Characteristics

In an embodiment, the layers of the various inventions described above are translucent. Further, the adhesives used, both to assemble the insoles and to provide the reusable adhesive on the lower layers, are also translucent during use of the insoles. In an embodiment, the lower layer of an orthotic device includes a material that has an inherent reusable adhesive or tacky property. However, in other embodiments of the invention, the lower layer may be processed or have a coating applied, so that the bottom has a reuseable adhesive or tacky property.

Further, certain embodiments of the present invention include an additional, decorative top layer. This decorative layer, being impermanently bonded to the rest of the insole, is removable and replaceable to allow coordination with shoes, clothing, or other accessories. In some embodiments, the top layer includes decorative fabric (e.g., prints including leopard spots, tiger stripes, flowers, cartoon characters, different colors, or others) or leather (e.g., aniline or semianiline leather, top grain leather, suede, or others). Exemplary properties of such a covering include durability, softness, and breathability.

The present invention provides a variety of reusable, adhesive, orthotic supportive devices and cushioning insoles which are discreet for open shoes. In addition, certain embodiments supplement support to the foot or assist in improving alignment of the spine and pelvis due to a leg length discrepancy of a wearer using open shoes. A device of the invention may be prescribed by podiatrist to improve biomechanical gait patterns or foot-related ailments.

There may be many variations of the invention and aspects of the invention are applicable to different types of orthotic devices. For example, although the invention has been described specifically for open shoes, one of skill in the art will recognize that the invention is equally applicable to closed shoes and will provide similar orthotic benefits.

This description of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications. This description will enable others skilled in the art to best utilize and practice the invention in various embodiments and with various modifications as are suited to a particular use. The scope of the invention is defined by the following claims.

The invention claimed is:

1. An orthotic supportive device comprising:

a first layer comprising a first thickness and cushion regions having a greater thickness than the first thickness;

a second layer, coupled to the first layer, comprising a semiflexible polymer having greater rigidity than the first layer; and a third layer, coupled to the second layer, comprising a viscoelastic polymer.

2. The device of claim 1 wherein the first, second, and third layers are translucent.

3. The device of claim 1 wherein a first cushion region of the first layer, positioned at a first position where a base of a heel of a foot will be received by the orthotic device, whereby the first cushion region cushions a calcaneus of the foot.

4. The device of claim 1 wherein a first cushion region of the first layer is positioned at a first position which will receive a medial arch zone of a foot.

5. The device of claim 1 wherein a first cushion region of the first layer is positioned at a first position which will receive a lateral arch zone of a foot.

6. The device of claim 3 wherein a second cushion region of the first layer is positioned around the first position and is U-shaped.

7. The device of claim 3 wherein a second cushion region of the first layer is positioned at a second position which will receive a metatarsal zone of the foot.

8. The device of claim 7 wherein a second cushion region of the first layer is positioned at a third position, forward and lateral of the second position.

9. The device of claim 3 wherein in the second layer at about the first position is a concavity.

10. The device of claim 3 wherein the viscoelastic polymer of the third layer is positioned at about the first second position.

11. The device of claim 3 wherein the second layer comprises first and second thickened regions, on a first and second side of the first position, extending away from the first layer.

12. The device of claim 7 wherein the viscoelastic polymer is not beneath the first and second thickened regions.

13. The device of claim 1 wherein the viscoelastic polymer has an inherent adhesive property.

14. The device of claim 1 wherein the first layer comprises at least six cushion regions.

15. The device of claim 1 wherein a first cushion region has a different thickness from a second cushion region.

16. The device of claim 1 wherein a first cushion region has the same thickness as a second cushion region.

17. An orthotic supportive device comprising:

a first layer comprising a first thickness and cushion regions having a greater thickness than the first thickness;

a second layer, coupled to the first layer, comprising a semiflexible polymer having greater rigidity than the first layer; and a third layer, coupled to the second layer, comprising a viscoelastic polymer, wherein the viscoelastic polymer has an inherent adhesive property, and the first, second, and third layers are translucent.

18. The device of claim 17 wherein a first of the cushion regions is above the viscoelastic polymer of the third layer.

19. The device of claim 18 wherein a second of the cushion regions is positioned to receive a metatarsal zone of a foot during use of the orthotic device.

* * * * *